United States Patent [19]

Maruno

[11] Patent Number: 5,076,057

[45] Date of Patent: Dec. 31, 1991

[54] HYDROMECHANICAL CONTINUOUSLY VARIABLE TRANSMISSION EMPLOYING PLUNGER-TYPE HYDRAULIC UNIT

[75] Inventor: Fujiya Maruno, Saitama, Japan

[73] Assignee: Honda Giken Kogyo Kabushiki Kaisha, Tokyo, Japan

[21] Appl. No.: 510,623

[22] Filed: Apr. 18, 1990

[30] Foreign Application Priority Data

Apr. 21, 1989 [JP] Japan ..... 1-102389
Sep. 14, 1989 [JP] Japan ..... 1-238785

[51] Int. Cl.[5] ..... F16D 39/00

[52] U.S. Cl. ..... 60/487; 60/489; 91/491; 91/492; 91/494; 91/495; 91/497; 91/498; 417/221

[58] Field of Search ..... 60/487, 489, 490; 91/491, 492, 494, 495, 497, 498; 417/221

[56] References Cited

U.S. PATENT DOCUMENTS

| | | | |
|---|---|---|---|
| 1,660,183 | 10/1926 | Weeden | 417/221 X |
| 2,316,115 | 4/1941 | Thompson | 91/495 |
| 2,392,754 | 1/1946 | Mercier | 91/494 X |
| 2,844,002 | 7/1958 | Payesl . | |
| 3,002,462 | 10/1961 | Raymond | 417/221 X |
| 3,118,388 | 1/1964 | Eriksson | 91/492 |
| 3,973,400 | 8/1976 | Peterson | 60/480 X |
| 4,006,668 | 2/1977 | Steiger | 91/498 X |
| 4,126,994 | 11/1978 | Rockwell | 91/492 X |
| 4,581,896 | 4/1986 | Andresen | 60/489 |
| 4,745,748 | 5/1988 | Hayashi | 60/489 |
| 4,747,269 | 5/1988 | David | 60/490 X |
| 4,777,866 | 10/1988 | Tan | 91/494 X |
| 4,781,022 | 11/1988 | Hayashi et al. | 60/489 |
| 4,914,914 | 4/1990 | Inoue | 91/497 X |
| 4,920,859 | 5/1990 | Smart et al. | 91/497 |

FOREIGN PATENT DOCUMENTS

| | | | |
|---|---|---|---|
| 931293 | 10/1952 | France | 91/495 |
| 61-153057 | 7/1986 | Japan . | |

OTHER PUBLICATIONS

Summary of Japanese 61-153057 in English, Jul. 1986.

*Primary Examiner*—Edward K. Look
*Assistant Examiner*—Todd Mattingly
*Attorney, Agent, or Firm*—Lyon & Lyon

[57] ABSTRACT

A variable-stroke crank mechanism includes a crankshaft rotatably mounted in a casing and having an eccentric crankpin, and a plurality of fluid pressure actuators disposed substantially radially with respect to the crankshaft, for pressing the eccentric crankpin to rotate the main shaft and the casing relatively to each other. The fluid pressure actuators are selectively supplied with a working fluid. An eccentric collar is rotatably mounted on the crankpin and operatively coupled to the fluid pressure actuators. The eccentric collar having an axis which is eccentrically displaced with respect to the axis of the crankpin. The crankpin and the eccentric collar are arrested in their respective angular positions by intermeshing internal and external gears. The crank mechanism may be incorporated in a plunger-type hydraulic unit, which may also be incorporated in a hydromechanical continuously variable transmission.

35 Claims, 16 Drawing Sheets

HYDROMECHANICAL CONTINUOUSLY VARIABLE TRANSMISSION EMPLOYING PLUNGER-TYPE HYDRAULIC UNIT

BACKGROUND OF THE INVENTION

The present invention relates to a variable-stroke crank mechanism, and more particularly to a variable-stroke crank mechanism for use in a fluid pressure device, the crank mechanism having a plurality of fluid pressure actuators for relatively rotating a casing and a crankshaft which is rotatably mounted in the casing. The present invention also relates to a plunger-type hydraulic unit which employs such a variable-stroke crank mechanism and can be used as a hydraulic pump, a hydraulic motor, or the like, and to a hydromechanical continuously variable transmission which employs such a plunger-type hydraulic unit.

Fluid pressure device include hydraulic devices which utilize oil as a working fluid, such as hydraulic motors, hydraulic pumps, or the like. Some hydraulic devices comprise a casing, a crankshaft (main shaft) rotatably mounted in the casing, and a plurality of hydraulic actuators disposed substantially radially with respect to the crankshaft, for pressing a crankpin of the crankshaft to rotate the crankshaft and the casing relatively to each other.

When such a hydraulic device is used as a hydraulic motor, the hydraulic actuators are successively operated to produce rotational forces which tend to rotate the crankpin around the crankshaft. When the hydraulic device is used as a hydraulic pump, the crankshaft is rotated about its own axis by a suitable power source to successively operate the hydraulic actuators, thereby pressurizing and discharging the working oil.

Heretofore, the hydraulic actuators and the crankpin are operatively interconnected by a connecting rod assembly as shown in FIG. 16 or 17 of the accompanying drawings.

FIGS. 16 and 17 show conventional connecting rod assemblies 301, 302, respectively. Each of the connecting rod assemblies 301, 302 comprises a main connecting rod 303 having a larger-diameter end 303*a* rotatably mounted on the crankpin and a plurality of auxiliary connecting rods 305 with ends angularly movably coupled to the end 303*a* of the main connecting rod 303 through respective coupling pins 304. The connecting rods 303, 305 having opposite ends 303*b*, 305*b* angularly movably coupled to the movable members (not shown) of the hydraulic actuators.

The center of the larger-diameter end 303*a* of the main connecting rod 303 is coaxial with the central axis of the crankpin. In other words, the conventional hydraulic devices having a fixed displacement. Therefore, they suffer the following drawbacks:

When the hydraulic device is used as a hydraulic motor, if the rotational speed of the crankshaft or the output torque of the hydraulic motor is to vary, then the pressure or rate of flow of the working oil to be supplied to the hydraulic actuators should be regulated. To regulate the pressure of the working oil, the output pressure of a compressor which pressurizes the working oil must be regulated. Since the regulation of the compressor output pressure is a complex process, the working oil pressure cannot be regulated in small steps. To regulate the rate of flow of the working oil, it is necessary to have a restriction disposed in the supply passage of the working oil. The restriction, however, increases the resistance imposed to the oil flow by the supply passage.

When the hydraulic device is used as a hydraulic pump, the rate at which the working oil is discharged from the hydraulic pump cannot be adjusted since the hydraulic actuators have a constant stroke. If the pressure under which the working oil is discharged from the pump is to be regulated, the output power of a drive source, such as a motor, which rotates the crankshaft has to be adjusted. As a result, the pressure of the discharged working oil cannot be regulated in small steps.

Hydraulic pumps or motors which incorporate hydraulic actuators operable by the crank mechanism of the type described above are well known in the art as radial- and axial-plunger-type hydraulic pumps or motors. Hydraulic continuously variable transmissions which employ such hydraulic pumps and motors are also well known in the art.

For example, Japanese Laid-Open Patent Publication No. 61(1986)-153057 and U.S. Pat. No. 2,844,002 disclose such hydraulic continuously variable transmissions. The disclosed transmissions comprise axial-plunger-type hydraulic pump and motor as hydraulic units. The pump and the motor are arranged back to back, and have respective pump and motor cylinder casings that are integrally joined to each other. The pump has a pump shaft as an input shaft, and the motor has a motor shaft as an output shaft, the pump and motor shafts being coaxial with each other. When the input shaft is driven to rotate about its own axis, working oil discharged under pressure from the pump is sent to drive the motor, with the motor shaft rotating as the transmission output shaft. A distribution mechanism for transmitting the working oil between the pump and the motor is disposed between the pump and the motor.

The distribution mechanism comprises a distribution housing integrally coupled to the pump and motor cylinder casings, a distribution spool radially slidably disposed in the housing, and a distribution cam for imparting sliding motion to the distribution spool.

In the transmission disclosed in Japanese Laid-Open Patent Publication No. 61(1986)-153057, the distribution cam is a member attached in surrounding relation to the distribution housing and having an inner peripheral surface held against an outer end of the distribution spool. The inner peripheral surface of the distribution cam is positioned eccentrically with respect to the axes of the pump and motor cylinder casings. A mechanism having such distribution cam will hereinafter be referred to as an outer cam mechanism. When the pump and motor cylinder casings are rotated to rotate the distribution housing therewith, the distribution spool also rotates with the distribution housing, and is guided by abutment against the inner peripheral surface of the distribution cam so that the distribution spool is reciprocally moved radially by a distance which is the same as the distance by which the inner peripheral surface of the distribution cam is eccentric with respect to the axes of the pump and motor cylinder casings.

An oil passage communicating with cylinder bores in the pump cylinder casing and an oil passage communicating with cylinder bores in the motor cylinder casing are defined in the distribution housing. When the distribution spool is reciprocally moved radially, those cylinder bores in the pump cylinder casing which are in a compression stroke and those cylinder bores in the motor cylinder casing which are in an expansion stroke communicate with each other, and those cylinder bores in the pump cylinder casing which are in an expansion stroke and those cylinder bores in the motor cylinder casing which are in a compression stroke communicate with each other. Therefore, the working oil that is discharged from the pump is sent to the motor, rotating the motor shaft, and is then returned to the inlet port of the pump.

In the transmission disclosed in U.S. Pat. No. 2,844,002, the distribution cam is a ring-shaped member attached to the distal end of a support member projecting into the motor in surrounding relation to the motor shaft, the ring-shaped member being disposed eccentrically with respect to the motor shaft. The ring-shaped member has a outer peripheral surface held against an inner end of the distribution spool. A mechanism having such distribution cam will hereinafter be referred to as an inner cam mechanism. Upon rotation of the distribution housing, the distribution spool is also reciprocally moved radially by a distance which is the same as the distance by which the the distribution cam is eccentric with respect to the motor shaft.

With the inner cam mechanism employed, it is necessary to provide a fixed support member which supports the inner cam mechanism, the fixed support member projecting into the motor in surrounding relation to the motor shaft. Therefore, the entire structure is complex. According to the disclosed arrangement, the inner cam mechanism is fixedly supported by the fixed support member and its eccentric position is also fixed. If it is required to rotate the distribution cam to move its eccentric position for reversing the direction of rotation of the motor shaft, then a mechanism for rotating the distribution cam becomes complicated in the case of the inner cam mechanism.

The outer cam mechanism is advantageous in that its structure is simpler because the distribution cam is directly supported by the transmission housing. However, the inner peripheral surface of the distribution cam against which the outer end of the distribution spool is held has a large diameter, and the inner peripheral surface of the distribution cam and the outer end of the distribution spool, which are held against each other, move relatively to each other at a high relative speed. As a result, these abutting surfaces tend to suffer seizure and wear.

SUMMARY OF THE INVENTION

It is an object of the present invention to provide a crank mechanism with a stroke being variable so that the output of a hydraulic pump or motor can easily be regulated.

Another object of the present invention is to provide a hydraulic unit having a distribution cam which is relatively simple in structure, can very its eccentric position, and employs an inner cam mechanism to allow abutting surfaces of the distribution cam and a distribution spool to slide relatively to each other at a low speed.

Still another object of the present invention is to provide a hydromechanical continuously variable transmission which incorporates such a hydraulic unit.

According to the present invention, there is provided a variable-stroke crank mechanism comprising a casing, a crankshaft (main shaft) rotatably mounted in the casing, the crankshaft having an eccentric crankpin, the crankpin having a first axis, a plurality of fluid pressure actuators disposed substantially radially with respect to the crankshaft, for pressing the eccentric crankpin to rotate the crankshaft and the casing relatively to each other, working fluid supply means for selectively supplying a working fluid to the fluid pressure actuators, a cam member (eccentric collar) rotatably mounted on the crankpin and operatively coupled to the fluid pressure actuators, the eccentric cam member having a second axis which is eccentrically displaced with respect to the first axis, and arresting means disposed between the crankpin and the eccentric cam member, for arresting the crankpin and the eccentric cam member in respective angular positions.

When the eccentric cam member is angularly moved with respect to the crankpin, the second axis of the eccentric cam member is turned around the first axis of the crankpin, thereby varying the distance between the second axis of the eccentric cam member and the axis of the crankshaft. The angular position of the eccentric cam member which has been adjusted with respect to the crankpin is kept by the arresting means. When the variable-stroke crank mechanism is used as a fluid pressure motor, the torque transmitted from the fluid pressure actuators through the eccentric cam member to the crankshaft can be varied. When the variable-stroke crank mechanism is used as a fluid pressure pump, the stroke of the fluid pressure actuators can be varied to vary the rate at which a working fluid discharged from the fluid pressure actuators is discharged.

Since the distance by which the cam member is eccentric with respect to the crankshaft is continuously variable by continuous adjustment of the relative angular positions of the cam member and the crankpin, the torque and the rate at which the working fluid is discharged can also be continuously varied.

According to the present invention, there is also provided a plunger-type hydraulic unit comprising a fixed main shaft, a cam member mounted on the main shaft, a cylinder casing rotatable around the main shaft and having a plurality of cylinder bores defined therein, a plurality of plungers slidably fitted in the cylinder bores, respectively, and connected to the cam member, so that the plungers reciprocally move in the cylinder bores in response to rotation of the cylinder casing, and a distribution mechanism for selectively bringing the cylinder bores into communication with inlet and outlet ports. The distribution mechanism comprises a distribution housing integral to the cylinder casing, distribution spools radially slidably disposed in the distribution housing, a distribution cam rotatably mounted on one end of the main shaft and connected to radial inner ends of the distribution spools, and a drive shaft extending axially through the main shaft from the other end thereof to the one end and coupled to the distribution cam, whereby the distribution cam can be rotated on the main shaft by the drive shaft.

According to the present invention, there is further provided a hydromechanical continuously variable transmission comprising a transmission housing, pump and motor cylinder casing integrally coupled to each other and rotatably supported in the transmission housing, the pump and motor cylinder casings having cylinder bores, a plurality of pump plungers slidably disposed in the cylinder bores in the pump cylinder casing, a plurality of motor plungers slidably disposed in the cylinder bores in the motor cylinder casing, a pump shaft rotatably disposed in the pump cylinder casing in coaxial relation thereto, a pump cam member mounted on the pump shaft for reciprocally sliding the pump plungers, a motor shaft disposed coaxially in the motor cylinder casing and fixedly supported in the transmission housing, a motor cam member mounted on the motor shaft for rotating the motor cylinder casing in response to reciprocating movement of the motor plungers, and a distribution mechanism for selectively bringing the cylinder bores in the pump cylinder casing into communication with the cylinder bores in the motor cylinders. The distribution mechanism comprises a distribution housing integral to the pump and motor cylinder casings, distribution spools radially slidably disposed in the distribution housing, a distribution cam rotatably mounted on one end of the motor shaft and connected to radial inner ends of the distribution spools, and a drive shaft extending axially through the motor shaft from the other end thereof to the one end and coupled to the distribution cam, whereby the distribution cam can be rotated on the motor shaft by the drive shaft.

With the hydraulic unit constructed as described above, since the distribution mechanism comprises an inner cam mechanism, the speed at which cam surfaces slide is low. The distribution cam is rotatably mounted on the fixed main shaft and coupled through gears to the drive shaft extending through the main shaft. Therefore, when the drive shaft is rotated, the distribution cam is rotated, and its eccentricity can easily be changed.

In the hydromechanical continuously variable transmission, the hydraulic unit described above is used as a motor. The motor shaft is fixedly supported in the transmission housing, and the distribution cam in the form of an inner cam mechanism is rotatably mounted on the inner end of the motor shaft. Inasmuch as the drive shaft extending through the motor shaft is connected through gears to the distribution cam, the distribution cam can be rotated to change its eccentricity in response to rotation of the drive shaft.

The hydraulic unit, i.e., the hydraulic motor or pump, may be used as a radial- or axial-plunger-type pump or motor. With the radial-plunger-type pump or motor, the eccentric cam member for reciprocally moving the pump or motor plungers is rotated on a given eccentric axis to vary the displacement of the pump or motor. When the eccentric cam member is rotated, the top or bottom dead center of the plungers is also displaced. Therefore, it is also necessary to change the eccentricity of the distribution cam of the distribution mechanism. According to the present invention, such eccentricity control of the distribution cam can easily be achieved. The principles of the invention are particularly suitable for use in a radial-plunger-type hydraulic unit.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
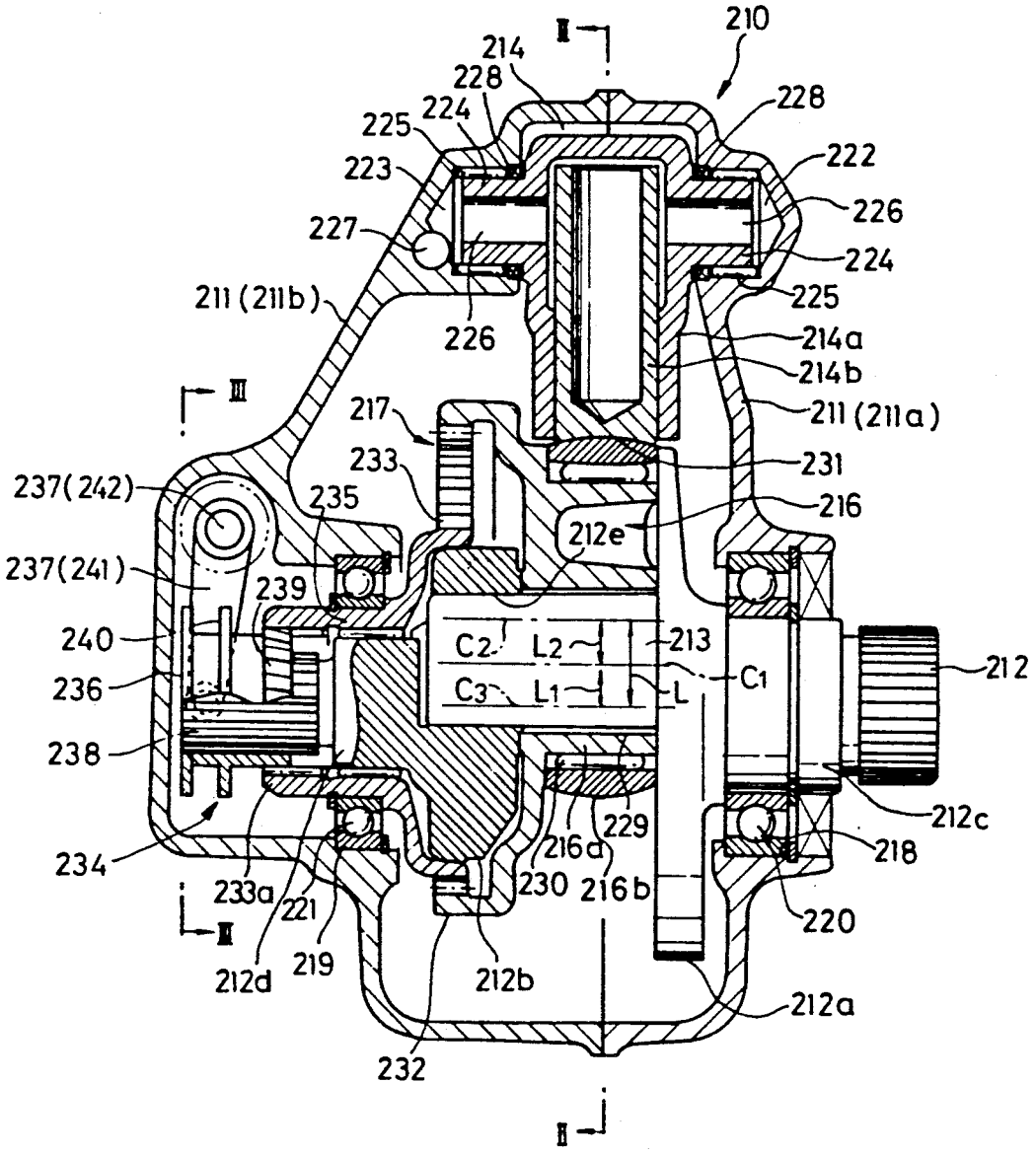
FIG. 1 is a vertical cross-sectional view of a variable-stroke crank mechanism according to an embodiment of the present invention.
Figure 2:
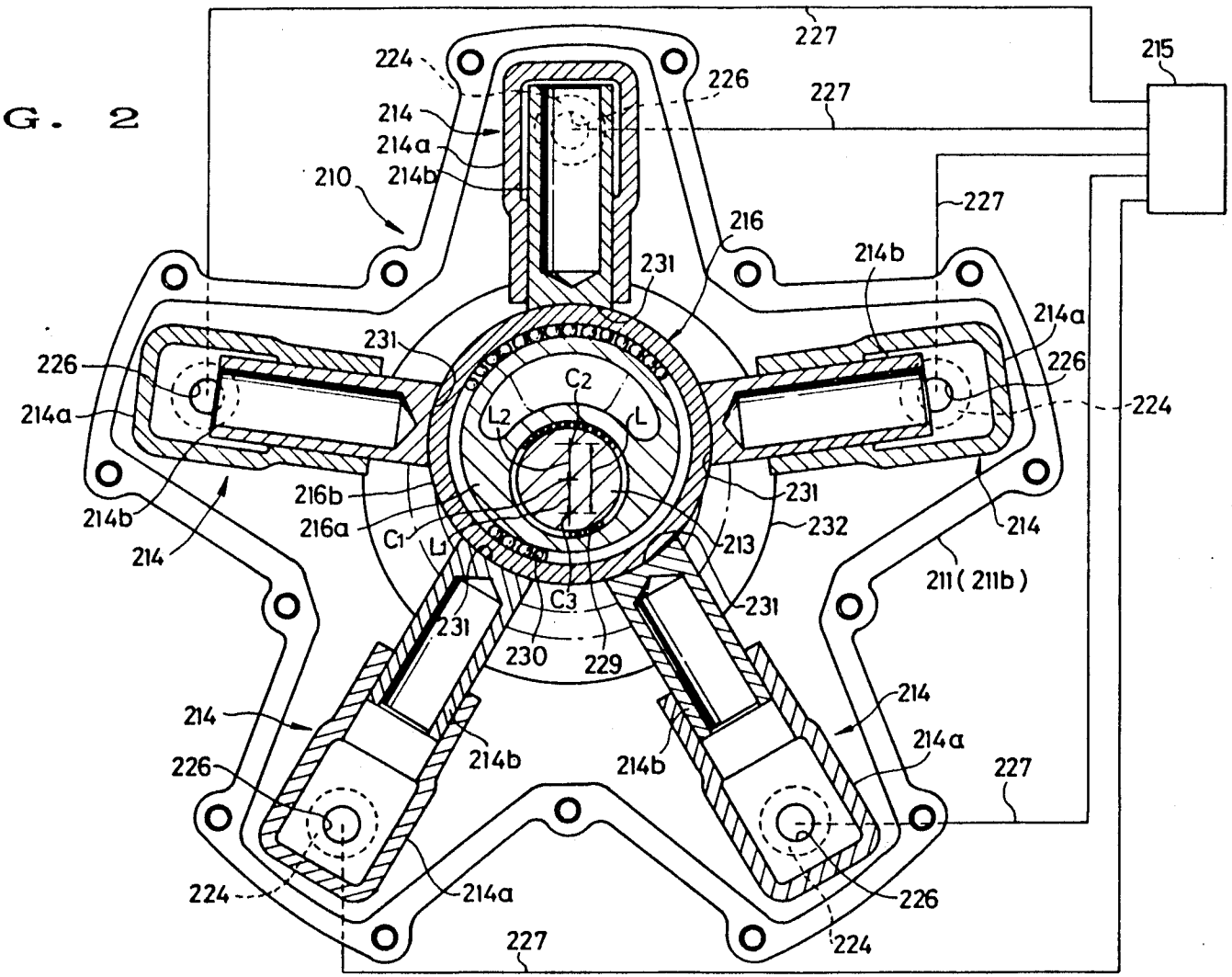
FIG. 2 is a cross-sectional view taken along line II—II of FIG. 1.

FIGS. 1 and 2 show a variable-stroke crank mechanism 210 according to an embodiment of the present invention. The crank mechanism 210 comprises a casing 211, a crankshaft (main shaft) 212 rotatably mounted in the casing 211, a plurality of fluid pressure actuators 214 disposed substantially radially with respect to the crankshaft 212, for pressing a crankpin 213 of the crankshaft 212 to rotate the crankshaft 212 and the casing 211 relatively to each other, and a working fluid supply means 215 for selectively supplying a working fluid to the fluid pressure actuators 214. The crankpin 213 has a central axis C1. An eccentric collar 216 is rotatably mounted on the crankpin 213, the eccentric collar 216 having a central axis C2 displaced eccentrically from the central axis C1 of the crankpin 213. The fluid pressure actuators 214 are held against the eccentric collar 216. Between the crankpin 213 and the eccentric collar 216, there is disposed an arresting means 217 for arresting the crankpin 213 and the eccentric collar 216 in their angular positions.

The crank mechanism 210 will be described in greater detail below. The casing 211 comprises two casing members 211*a*, 211*b* which are separate in the longitudinal direction of the crankshaft 212. The casing members 211*a*, 211*b* have respective central holes 218, 219 receiving crankshaft members 212*c*, 212*d* of the crankshaft 212. The crankshaft members 212*c*, 212*d* are rotatably supported in the holes 218, 219, respectively, by respective ball bearings 220, 221.

The crankshaft 212 comprises two crankshaft elements. One of the crankshaft elements comprises a web 212*a*, the crankshaft member 212*c* integrally extending from one side of the web 212*a*, and the crankpin 213 integrally projecting from the other side of the web 212*a*. The central axis C1 of the crankpin 213 is radially displaced from the central axis C3 of the crankshaft 212 by a distance L1. The other crankshaft element comprises a web 212b having a hole 212e in which the projecting end of the crankpin 213 is fitted, and the crankshaft member 212d integrally joined to the web 212b. The crankshaft elements are securely combined with each other when the crankpin 213 is force-fitted in the hole 212e in the web 212b.

The fluid pressure actuators 214 are in the form of hydraulic actuators. As shown in FIG. 2, there are five fluid pressure actuators 214 which are angularly spaced in the circumferential direction of the crankshaft 212. Each of the fluid pressure actuators 214 comprises a body 214a supported in the casing 211, and a plunger 214b slidably fitted in the body 214a.

As shown in FIG. 1, the body 214a of each fluid actuator 214 has a pair of pivot shafts 224 fitted in respective holes 222, 223 defined coaxially in the casing members 211a, 211b and projecting coaxially in the radial direction of the body 214a. These pivot shafts 224 are swingably supported in the casing members 211a, 221b by respective roller bearings 225 disposed in the holes 222, 223.

Each of the pivot shafts 224 has a working fluid passage 226 communicating with the interior or the body 214a. The working fluid passage 226 communicates through the hole 223 with a working fluid supply/discharge passage 227 which is defined in the casing member 211b, and also through the working fluid supply/discharge passage 227 with the working fluid supply means 215.

When a working fluid (oil in the present embodiment) is supplied from the working fluid supply means 215 into the bodies 214a of the fluid pressure actuators 214, the plungers 214b are moved toward the crankshaft 212. When the plungers 214b are pushed back in response to rotation of the crankshaft 212, the working fluid in the bodies 214a is discharged back to the working fluid supply means 215.

Fluid-tight seals 228 held tightly against the inner surfaces of the holes 222, 223 and the outer surfaces of the pivot shafts 224 are disposed in outer ends of the holes 222, 223.

The seals 228 prevent the working fluid supplied into the bodies 214a from leaking into the casing 211 through any gap between the pivot shafts 224 and the surfaces of the holes 222, 223, so that no undue pressure drop will occur. The seals 228 which are disposed in the outer ends of the holes 222, 223 also serve to guide the working fluid to the roller bearings 225 to lubricate them.

Each of the plungers 214b is of a hollow structure so that its inertial mass will be reduced when it slides, and hence the plunger 214b can move in response to rotation of the crankshaft 212 with high follow-up responses.

As shown in FIGS. 1 and 2, the eccentric collar 216 comprises a base 216a rotatably mounted on the crankpin 213 by a needle bearing 229, and an annular guide 216b rotatably mounted coaxially on the outer circumference of the base 216a by a needle bearing 230. The base 216a is of a substantially cylindrical shape and has its central axis C2 displaced from the center of the needle bearing 229, i.e., the central axis C1 of the crankpin 213 by a distance L2. Therefore, when the eccentric collar 216 are angularly moved with respect to the crankpin 213, the distance L between the axis C2 of the collar 216 and the axis C3 of the crankshaft 212 will vary.

As shown in FIG. 1, the guide 216b has an outer circumferential surface which is arcuate in shape as viewed in radial cross section. In view of this cross-sectional shape, together with the fact that the guide 216b is circular as viewed in its axial direction, the guide 216b has a spherical outer profile. The end surface of the plunger 214b of each fluid actuator 214 which is held in contact with the outer surface of the guide 216b is in the form of a complementary spherical recess 231, so that the plunger 214b and the guide 216b are held against each other through spherical contact surfaces.

When the plunger 214b tends to move laterally to the guide 216b, the guide 216b is prevented from moving axially and circumferentially by the spherical contact surfaces of the plunger 214b and the guide 216b. Therefore, the plunger 214b and the guide 216b are prevented from being positionally displaced with respect to each other.

The arresting means 217 will be described below.

As illustrated in FIG. 1, the arresting means 217 comprises an internal gear 232 integral with the base 216a of the eccentric collar 216, a pinion 233 mounted on the crankshaft 212 for allowing relative angular movement with respect to thereto and meshing with the internal gear 232, and a position adjusting mechanism 234 for adjusting the relative angular positions of the pinion 233 and the crankshaft 212.

The internal gear 232 projects axially from the base 216a coaxially with the central axis C1 of the crankpin 213 in surrounding relation to the web 212b of the crankshaft 212. The internal gear 232 is spaced a certain distance from the web 212b in the position where the internal gear 232 is closest to the web 212b.

The pinion 233 is of a substantially annular shape and coaxial with the crankshaft 212. The pinion 233 is positioned radially between the internal gear 232 and the web 212b and held in mesh with the internal gear 232. The pinion 233 has an inner circumferential surface slidably held against the substantially entire outer circumferential surface of the web 212b.

The pinion 233 has a hollow cylindrical member 233a extending in the axial direction of the crankshaft 212. The cylindrical member 233a is angularly movably supported in the casing member 211b by a ball bearing 211 fixed to the casing member 211b, and is prevented from axial movement by the ball bearing 221. The crankshaft 212 (crankshaft member 212d) is rotatably mounted in the cylindrical member 233a by a needle bearing 235. The crankshaft 212 is therefore rotatably supported in the casing member 211b by the needle bearing 235, the cylindrical member 233a, and the ball bearing 221. As shown in FIG. 1, the position adjusting mechanism 234 comprises a slider 236 interposed between the crankshaft 212 (crankshaft member 212d) and the cylindrical member 233a of the pinion 233, and an actuator means 237 for moving the slider 236 in the axial direction of the crankshaft 212.

The slider 236 is axially slidably fitted over the crankshaft member 212d through axially straight splines 238 on the crankshaft member 212d, and is also fitted in the cylindrical member 233a through helical splines 239 on the outer circumference of the slider 236. Therefore, when the slider 236 is axially slid by the actuator means 237, the pinion 233 is angularly moved with respect to the crankshaft 212, and the internal gear 232 meshing with the pinion 233 is rotated to angularly move the eccentric collar 216 and the crankpin 213 with respect to each other.

Figure 3:
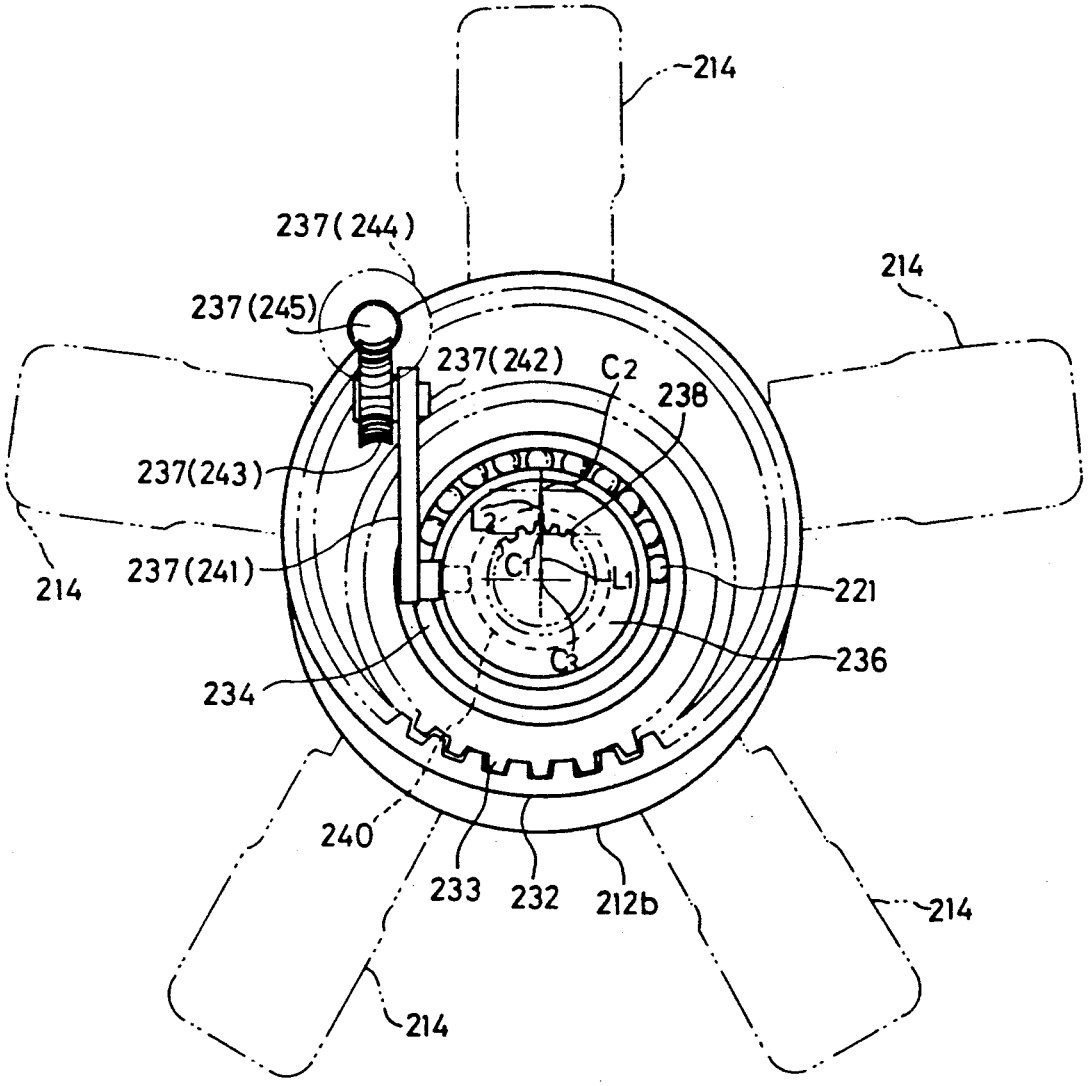
FIG. 3 is a cross-sectional view, partly omitted from illustration, taken along line III—III of FIG. 1.

The actuator means 237 comprises a swing arm 241 slidably engaging in a circumferential groove 240 defined in the outer circumferential surface of the slider 236, a drive shaft 242 on which the swing arm 241 is mounted, a worm wheel 243 (FIG. 3) mounted on the drive shaft 242, and a worm 245 meshing with the worm wheel 243 and rotatable by an electric motor 244 or the like. When the electric motor 244 is energized, the swing arm 241 swings to cause the slider 236 to slide axially, thereby rotating the pinion 233. When the electric motor 244 is de-energized, the worm wheel 243 and the worm 245 arrest the slider 236 against axial movement, so that the pinion 233 is fixed against rotation.

The working fluid supply means 215 starts supplying the working fluid into the bodies 214*a* when the plungers 214*b* of the fluid pressure actuators 214 are positioned near their top dead center (where the plungers 214*b* are pushed most deeply into the bodies 214*a*), and starts receiving the working fluid discharged from the bodies 214*a* when the plungers 214*b* begin to move from near the bottom dead center (where the plungers 214*b* project farthest from the bodies 214*a*) toward the top dead center.

Operation of the crank mechanism 210 as it operates as a hydraulic motor will be described below.

Those of the fluid pressure actuators 214 which are in contact with the eccentric collar 216 behind a line passing through the axes C3, C1 with respect to the direction in which the crankpin 213 rotates, are supplied with the working fluid from the working fluid supply means 215. At the same time, the working fluid supply/discharge passages 227 communicating with the remaining fluid pressure actuators 214 are opened.

The plungers 214*b* of the former fluid pressure actuators 214 are pushed out toward the bottom dead center, causing the eccentric collar 216 to rotate the crankpin 213 and hence the crankshaft 212.

When the crankshaft 212 is thus rotated, the plungers 214*b* of those fluid pressure actuators 214 which are supplied with the working fluid reach the bottom dead center. Then, the working fluid supply means 215 stops supplying the working fluid to those fluid pressure actuators 214, and the working fluid supply/discharge passages 227 communicating with those fluid pressure actuators 214 are opened by the working fluid supply means 215.

The above operation is successively effected with respect to those of the fluid pressure actuators 214 which are positioned ahead of the line passing through the axes C3, C1 with respect to the direction in which the crankpin 213 rotates. Therefore, the crankshaft 212 is continuously rotated.

The motor 244 of the position adjusting mechanism 234 of the arresting means 214 has been de-energized, holding the slider 236 in a certain position in the longitudinal direction of the crankshaft 212. The internal gear 232 and the pinion 233 are arrested in their angular positions.

The eccentric collar 216, the crankpin 213, and the crankshaft 212 are held in a given positional relationship. If such a positional relationship is selected such that the amount by which the eccentric collar 216 is eccentrically displaced with respect to the crankshaft 212 is maximum, the distance or crank radius L is equal to the sum of the distance L1 by which the crankpin 213 is eccentrically displayed with respect to the crankshaft 212 and the distance L2 by which the eccentric collar 216 is eccentrically displaced with respect to the crankpin 213.

If the pressure of the working fluid which is supplied from the working fluid supply means 215 to the fluid pressure actuators 214 is constant, then the torque which depends on the crank radius L (L1+L2) is transmitted to the crankshaft 212. If the eccentric collar 216 is in the maximum eccentric position as shown, then the maximum torque is transmitted to the crankshaft 212.

If the rate at which the working fluid is supplied from the working fluid supply means 215 to the fluid pressure actuators 214 is constant, then the rotational speed of the crankshaft 212 is held constant. In the illustrated embodiment, the rotational speed of the crankshaft 212 is minimum since the eccentric collar 216 is held in the maximum eccentric position.

To reduce the torque transmitted to the crankshaft 212 or increase the rotational speed of the crankshaft 212, the motor 244 is energized to rotate its output shaft in a selected direction to turn the swing arm 241, thereby moving the slider 236 in the axial direction of the crankshaft 212.

The pinion 233 is then rotated with respect to the crankshaft 212, and hence the internal gear 232 is rotated to rotate the eccentric collar 216 with respect to the crankpin 213.

As the eccentric collar 216 is thus rotated, the axis C2 thereof turns around the axis C1 of the crankpin 213 toward the axis C3 of the crankshaft 212, with the result that the crank radius L is reduced.

When the crank radius L is reduced, the torque transmitted to the crankshaft 212 is reduced insofar as the pressure of the working fluid is constant. When the stroke of the plungers 214*b* is reduced, the rotational speed of the crankshaft 212 is increased insofar as the rate at which the working fluid is supplied to the variable-stroke crank mechanism 210 is constant.

Therefore, the torque transmitted to the crankshaft 212 and the rotational speed of the crankshaft 212 can be varied by the position adjusting mechanism 234, and the angular position of the eccentric collar 216 can be continuously adjusted by the position adjusting mechanism 234.

Regardless of the eccentric collar 216 being disposed centrally on the crankshaft 212, the eccentric collar 216 can be positionally adjusted at one end of the crankshaft 212.

Since the inner circumferential surface of the pinion 233 is supported in its entirety by the web 212*b* of the crankshaft 212, the pinion 233 and the crankshaft 212 are accurately held coaxially with each other, and the pinion 233 is prevented from being tilted or angularly displaced in the axial direction of the crankshaft 212. As a consequence, the eccentric collar 216 can smoothly be adjusted in angular position.

While the pinion 233 is shown as being supported along the entire inner circumferential surface thereof on the web 212*b*, only the region of the pinion 233 where it meshes with the internal gear 232 may be supported on the web 212*b*.

If the distance L1 by which the crankpin 213 is eccentrically displaced with respect to the crankshaft members 212*c*, 212*d* is equalized to the distance L2 by which the eccentric collar 216 is eccentrically displaced with respect to the crankpin 213, then the crankshaft 212 may be stopped against rotation when the axis C2 of the eccentric collar 216 and the axis C3 of the crankshaft 212 are brought into alignment with each other. With this arrangement, the output power of the crank mechanism 210 can be reduced to zero without use of any special device such as a clutch. In this mode of operation, the crankshaft 212 and the casing 211 are integrally joined to each other through the fluid pressure actuators 214.

In the above description, the casing 211 is fixed and the crankshaft 212 rotates with respect thereto. However, the crankshaft 212 may be fixed and the casing 212 may rotate relatively thereto.

The crank mechanism 210 has been described as being used as a hydraulic motor in the above embodiment. However, the crank mechanism 210 may function as a hydraulic pump when the casing 211 and the crankshaft 212 are forcibly rotated relatively to each other by a suitable drive source to reciprocally move the plungers 214*b* for drawing the working fluid into the bodies 214*a* and discharging the working fluid therefrom. With the crank mechanism 210 used as a hydraulic pump, the rate at which the working fluid is discharged from the pump can be continuously adjusted from a zero level to a certain level when the distances L1, L2 are equalized to each other. In this mode of operation, it is also not required to use a special device such as a clutch.

Figure 4:
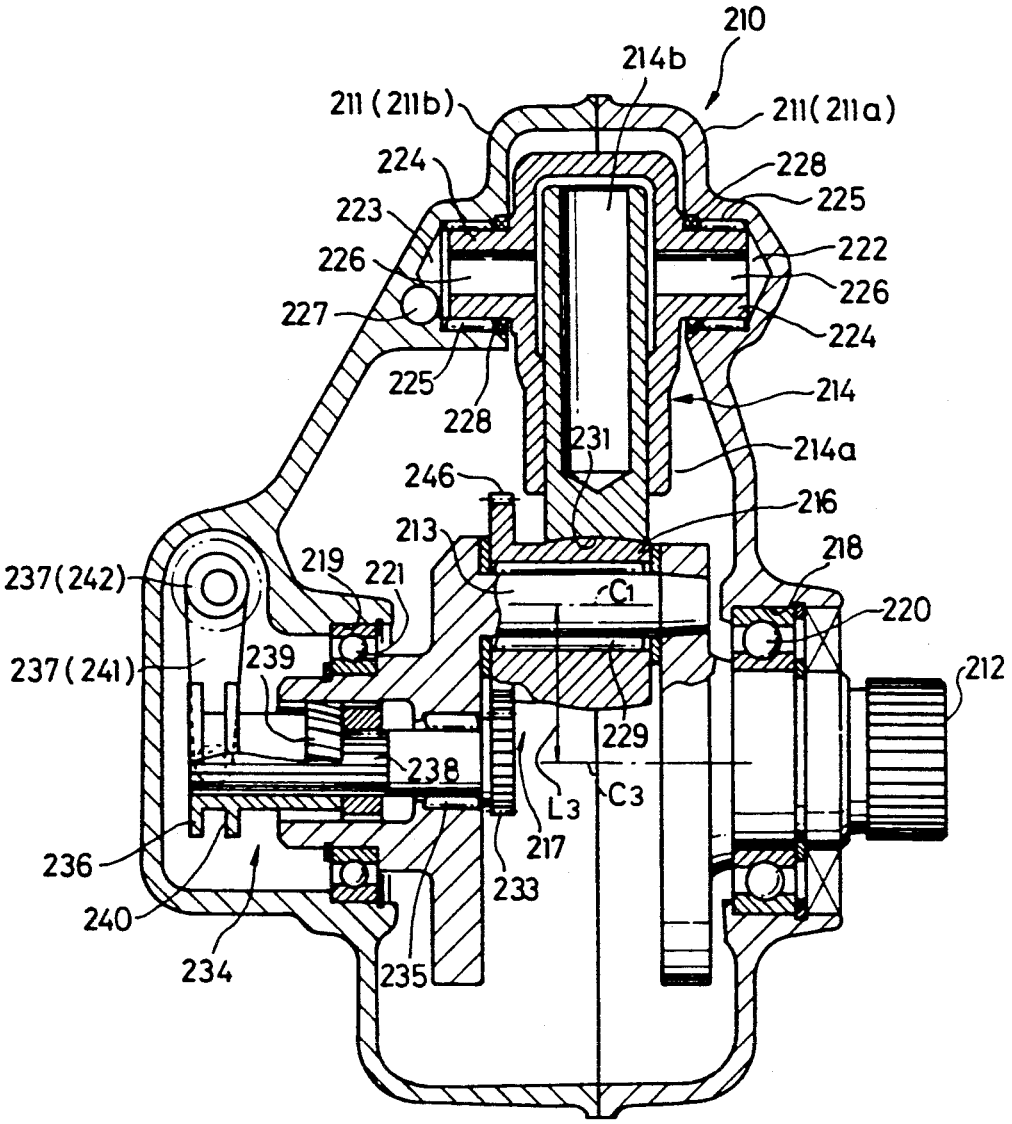
FIG. 4 is a vertical cross-sectional view of a variable-stroke crank mechanism according to another embodiment of the present invention.

FIG. 4 shows a crank mechanism according to another embodiment of the present invention. The crank mechanism shown in FIG. 4 differs from the crank mechanism shown in FIGS. 1 through 3 in that an external gear 246 which is positioned between the webs 212*a*, 212*b* is employed instead of the internal gear 232, and the pinion 233 extends axially through the crankshaft 212 and is disposed between the webs 212*a*, 212*b*, the pinion 233 meshing with the external gear 246.

With the construction shown in FIG. 4, where the distance L3 between the central axis C1 of the crankpin 213 and the central axis C3 of the crankshaft 212 is increased for an increased minimum torque to be produced by the crank mechanism, any resultant increase in the size of the arresting means 217 is minimized.

The other structural details and operation of the crank mechanism shown in FIG. 4 are the same as those of the previous crank mechanism.

The configurations and dimensions of the various components of the crank mechanisms in the above embodiments are shown by way of example only, and may be modified to meet various design requirements.

In the foregoing embodiments, the fluid pressure actuators are of the plunger type and their plungers 214*b* are held in direct abutment against the eccentric collar 216. However, the plungers 214*b* may be coupled to the eccentric collar 216 by pins.

Figure 5:
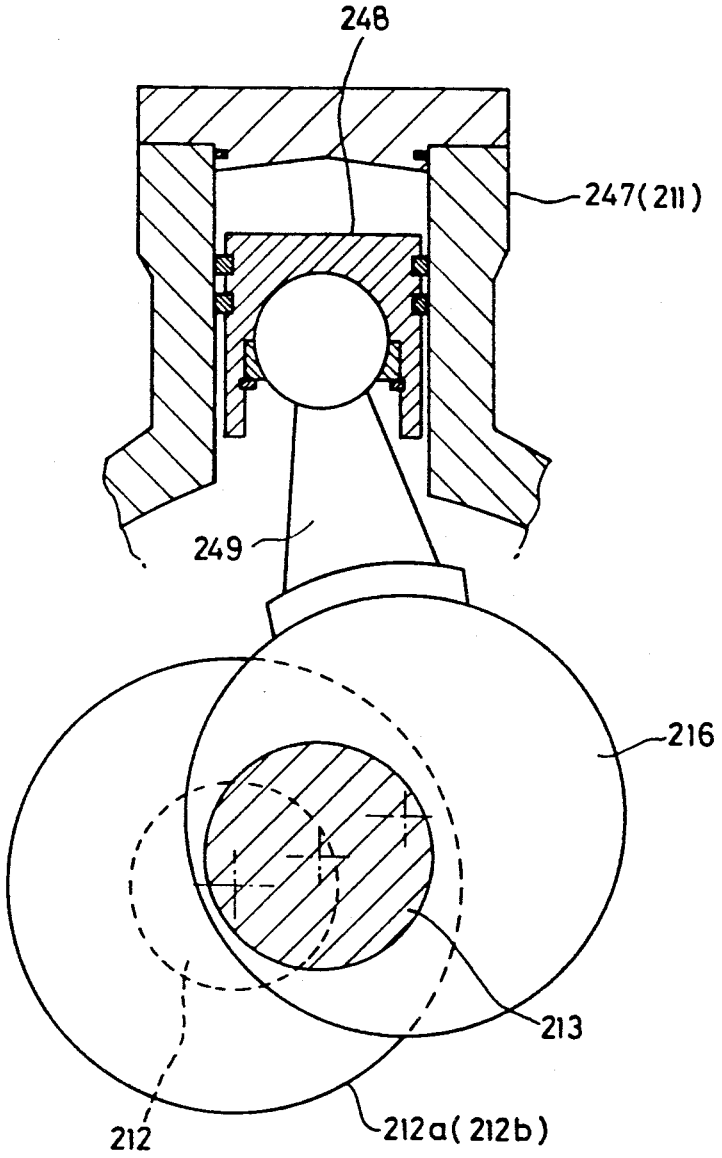
FIGS. 5 and 6 are fragmentary cross-sectional views showing modifications of the present invention.

FIG. 5 illustrates a further embodiment in which each hydraulic actuator comprises a cylinder 247 and a piston 248 slidably fitted therein. A connecting rod 249 swingably coupled to the piston 248 is held against the eccentric collar 216. Alternatively, the connecting rod 249 may be coupled to the eccentric collar 216 by a pin.

The position adjusting mechanism is disposed between the pinion 233 and the crankshaft 212 in the aforesaid embodiments. However, the position adjusting mechanism may be dispensed with. According to such a modification, the pinion 233 is detachably mounted directly on the crankshaft 212 through straight splines. Only when the eccentric position of the eccentric collar 216 is to be adjusted, the pinion 233 is removed. Then, the internal gear 232 or the external gear 246 is turned for eccentric position adjustment. The pinion 233 is mounted on the crankshaft 212 again in mesh with the gear 232 or 246.

Figure 6:
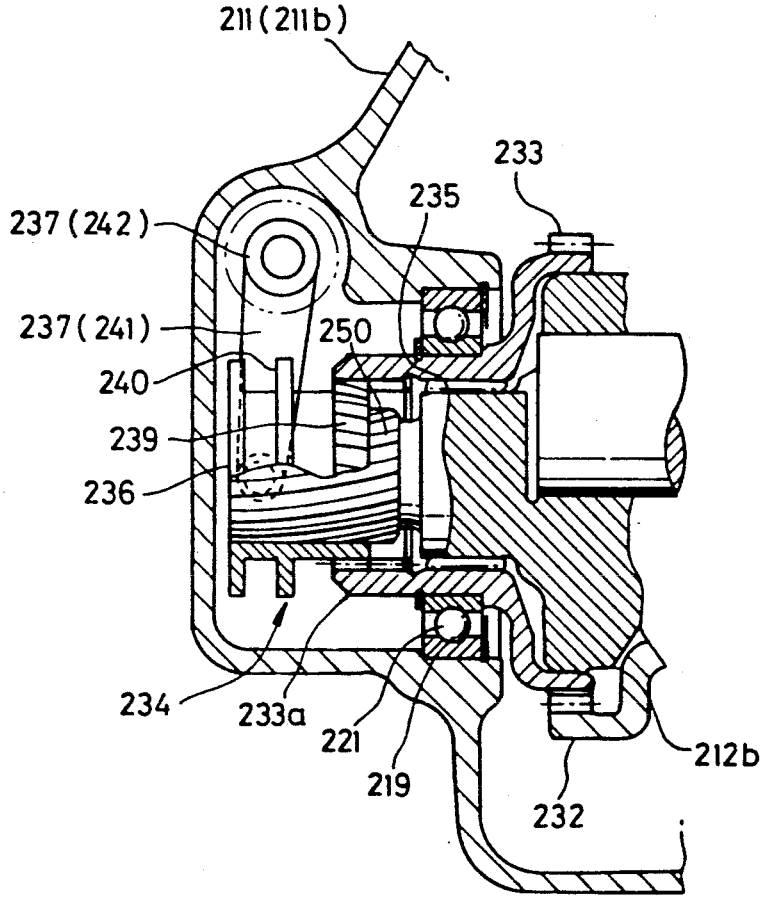

In the illustrated embodiments, the pinion 233 is angularly moved through the straight splines 238 and the helical splined 239 on the inner and outer surfaces of the slider 236 of the position adjusting mechanism 234. Instead, as shown in FIG. 6, the pinion 233 may be angularly moved through helical splines 239, 250 on the outer and inner surface of the pinion 233, the helical splines 239, 250 being inclined in opposite directions. The helical splines 239, 250 are effective to turn the pinion 233 for positionally adjusting the eccentric collar 216 in response to reduced axial movement of the slider 236.

The working fluid is described as being oil. However, pneumatic pressure or steam pressure may be employed to operate the crank mechanism according to the present invention.

Figure 7:
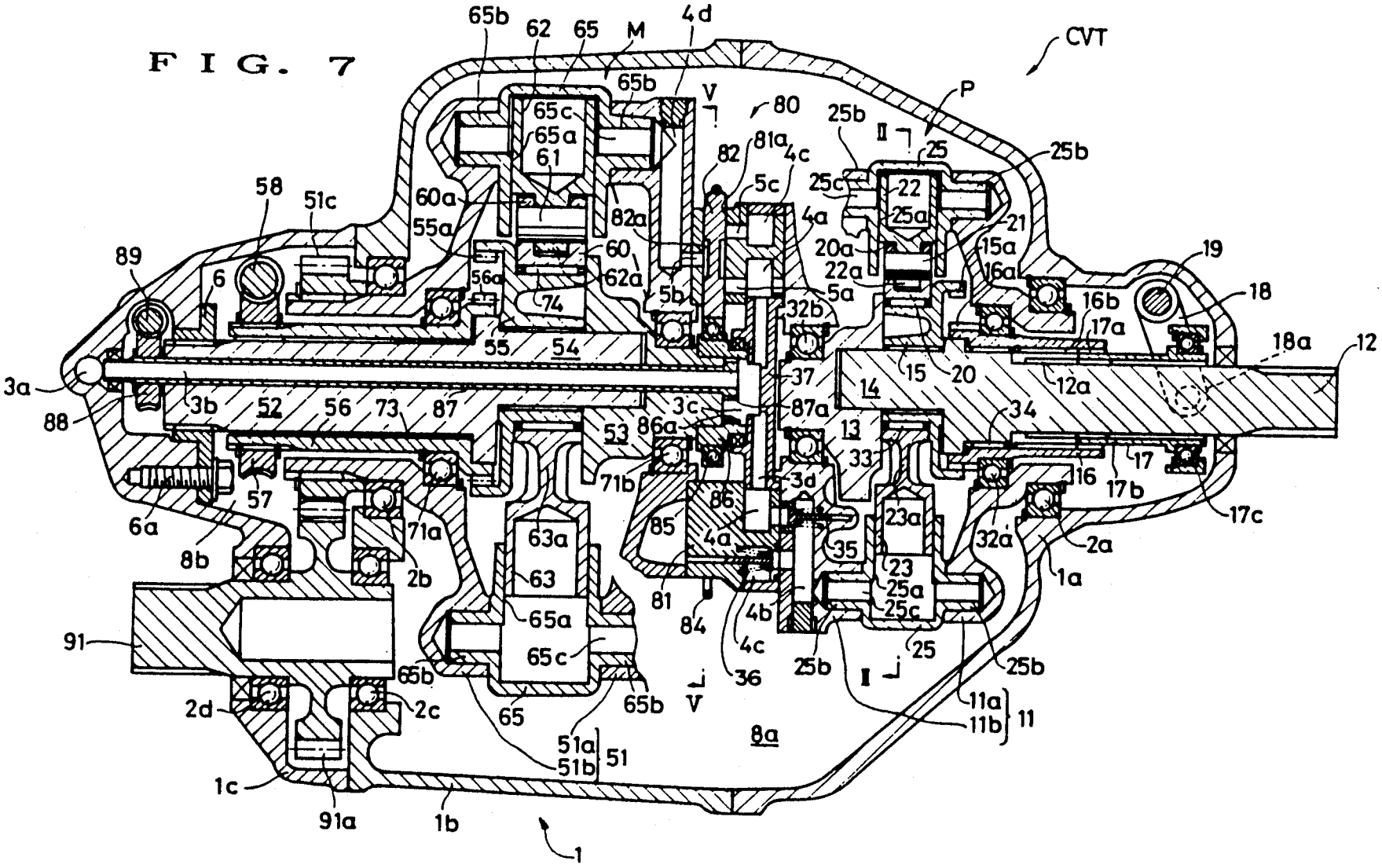
FIG. 7 is a cross-sectional view of a hydromechanical continuously variable transmission according to an embodiment of the present invention.

FIG. 7 shows a hydromechanical continuously variable transmission CVT according to an embodiment of the present invention. The continuously variable transmission CVT comprises a radial-type hydraulic pump P and a radial-type hydraulic motor M which are accommodated in a transmission housing 1. Each of the hydraulic pump P and the hydraulic motor M has a variable displacement. The displacement of one or both of the hydraulic pump P and the hydraulic motor M is varied to continuously vary the rotational speed of a transmission output shaft 91, which is transmitted from a transmission input shaft 12.

The transmission housing 1 is composed of three housing members, i.e., a first housing member 1*a*, a second housing member 1*b*, and a third housing member 1*c*. The hydraulic pump P and the hydraulic motor M are disposed in a first space 8*c* defined in and surrounded by the first and second housing members 1*a*, 1*b*. The second and third housing members 1*b*, 1*c* define and surround a second space 8*b* in which an output gear train is disposed.

The hydraulic pump P will first be described with reference to FIG. 8.

The hydraulic pump P has a pump casing 11 which is coupled to a motor casing 51 (described later) and rotatably supported in the transmission housing 1 by ball bearings 2*a*, 2*b*. The pump casing 11 comprises two casing members 11*a*, 11*b* which are fastened to each other by a plurality of bolts 29.

The pump P has a main shaft 12, which serves as the transmission input shaft, projects out of the transmission housing 1 so that the main shaft 12 can be driven from an external power unit. The main shaft 12 has an integral crankpin 14 on its inner end, the crankpin 14 having a central axis C2 which is eccentrically displaced from the central axis C1 of the main shaft 12 by distance L1. The crankpin 14 has its distal end fitted in a shaft support member 13. The main shaft 12, the crankpin 14, and the shaft support member 13 are rotatably supported as a unitary structure in the pump casing 11 by ball bearings 32*a*, 32*b*, and are rotatable about the central axis C1. Therefore, the axis C2 of the crankpin 14 revolves around the axis C1. Between the main shaft 12 and the bearing 32*a*, there are disposed a needle bearing 34 and a rotatable movable sleeve 16.

An eccentric collar 15 is rotatably mounted on the crankpin 14, the eccentric collar 15 having a central axis C3 which is eccentrically displaced from the crankpin axis C2 by a distance L2. The eccentric collar 15 has a internal gear 15*a* on one axial side thereof, the internal gear 15a meshing with an external gear 16a of the rotatable sleeve 16.

The rotatable sleeve 16 is angularly movably mounted on the main shaft 12 by the needle bearing 34. An axially slidable sleeve 17 is slidably mounted on the main shaft 12 through its internal splines 17b meshing with external splines 12a of the main shaft 12. The slidable sleeve 17 has external splines 17a meshing with internal splines 16b of the rotatable sleeve 16. Therefore, the main shaft 12, the slidable sleeve 17, the rotatable sleeve 16, and the eccentric collar 15 rotate in unison with each other. Upon such rotation, the axis C3 of the eccentric collar 15 revolves around the axis C1.

The internal gear 15a of the eccentric collar 15, the rotatable sleeve 16, and the slidable sleeve 17 jointly serve as an arresting means for arresting the eccentric collar 15 against rotation. This arresting means and the eccentric collar 15 constitute a pump cam member.

The internal splines 17b of the slidable sleeve 17 and the external splines 12a of the main shaft 12 comprise axially straight splines, and the external splines 17a of the slidable sleeve 17 and the internal splines 16b of the rotatable sleeve 16 comprise helical splines. Therefore, when the slidable sleeve 17 axially slides, the rotatable sleeve 16 rotates relatively to the main shaft 12 through the intermeshing helical splines. The rotation of the rotatable sleeve 16 is transmitted through the gears 16a, 15a to the eccentric collar 15, which is then angularly moved about the crankpin 14. The arresting means referred to above therefore includes a position adjusting mechanism for adjusting the angular position of the eccentric collar 15.

The internal splines 17b and the external splines 12a may comprise helical splines, and the external splines 17a and the internal splines 16b may comprise straight splines. Alternatively, all these splines may helical splines.

Figure 9:
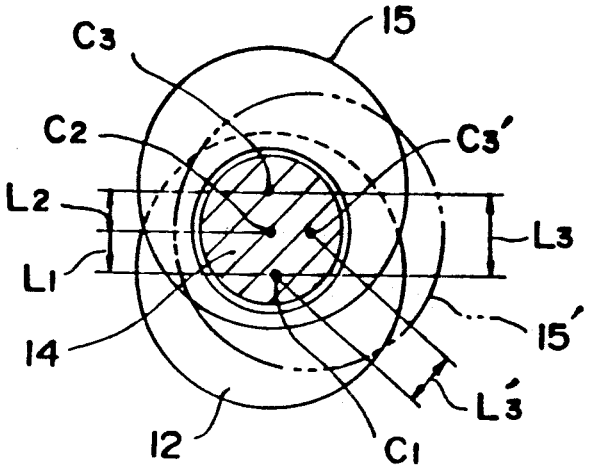
FIG. 9 is a schematic view showing the positional relationship between the axes of members of the hydraulic pump.

FIG. 9 shows the manner in which the axis C3 of the eccentric collar 15 moves upon angular movement thereof. In FIG. 9, the eccentric collar 15 is shown as being angularly moved 90° clockwise about the crankpin 14, as indicated by the two-dot-and-dash line. Before the eccentric collar 15 is angularly moved, the axis C1 of the main shaft 12, the axis C2 of the crankpin 14, and the axis C3 of the eccentric collar 15 are positioned in line. At this time, the axis C3 is spaced from the axis C1 by a distance L3 which is the same as the sum of the distances L1, L2. When the eccentric collar 15 is turned 90° about the crankpin 14 into a position indicated by 15', the axis C3 of the eccentric collar 15 moves to a position indicated by C3'. Therefore, the distance between the axis C1 of the main shaft 12 and the axis C3 of the eccentric collar 15 (i.e., the radius with which the axis C3 of the eccentric collar 15 will revolve around the axis C1 of the main shaft 12 in the operation of the transmission CVT) becomes L3' (<L3).

The distance L3 is maximum when the axes C1, C2, C3 are arranged in line as shown in FIG. 9. As the eccentric collar 15 is progressively angularly moved, the distance L3 decreases. The distance L3 becomes minimum when the eccentric collar 15 is turned 180°. If the distance L1 and the distance L2 are equal to each other, the distance L3 becomes zero when the eccentric collar 15 is turned 180°.

Consequently, when the slidable sleeve 17 is axially moved, the distance (revolving radius) L3 of the axis C3 of the eccentric collar 15 to the axis C1 of the main shaft 12 is varied. A lever 18 has an end 18a engaging a bearing 17c mounted on an end of the slidable sleeve 17 and is angularly movable about a shaft 19. The movement of the slidable sleeve 17 is effected when the lever 18 is turned about the shaft 19.

A coupling ring 20 is rotatably mounted on the eccentric collar 15 by a needle bearing 33, so that the coupling ring 20 is rotatable on the eccentric collar 15 about the axis C3 thereof. Seven radial pump cylinders 25 are disposed around the coupling ring 20. Each of the pump cylinders 25 is swingably supported in the pump casing 11 by a pair of trunnions 25b.

The cylinders 25 have respective cylinder bores 25a opening radially inwardly. Six pump plungers 22 and one pump plunger 23 are slidably inserted in the respective cylinder bores 25a through their radially inner ends. The six pump plungers 22 have radially inner ends 22a pivotally coupled to six arms 20a, respectively, of the coupling ring 20 by pins 21. The one pump plunger 23 has a radially inner end 23a integral to the coupling ring 20.

The cylinder bores 25a communicate with a second circuit oil passage 4b defined in the pump casing 11 through an oil passage 25c which is defined in those trunnions 25b which are disposed on one side of the cylinder bores 25a. The second circuit oil passage 4b communicates with a first circuit oil passage 4a through a check valve 35 which allows an oil flow in only a direction from the first circuit oil passage 4a to the second circuit oil passage 4b. The second circuit oil passage 4b also communicates with a third circuit oil passage 4c through a check valve 36 which allows an oil flow in only a direction from the second circuit oil passage 4b to the third circuit oil passage 4c.

The first circuit oil passage 4a is connected to an oil sump in the transmission housing 1 through first through fourth oil supplementing passages 3a through 3d. The first oil supplementing passage 3a communicates with the oil sump in the transmission housing 1. The second oil supplementing passage 3b is defined in a drive shaft 87 (described later) extending axially through a motor main shaft 52. The third oil supplementing passage 3c is defined in a space between the motor main shaft 52 and a body 81 of a distribution mechanism (described later), and the fourth oil supplementing passage 3d is defined in an oil delivery member 37 fixed to the body 81.

The hydraulic motor M will now be described below. The hydraulic motor M has main components which are similar in structure to those of the hydraulic pump P.

The hydraulic motor M has a motor casing 51 comprising two casing members 51a, 51b which are fastened to each other by a plurality of bolts (not shown). The motor casing 51 is integral to the pump casing 11.

Figure 10:
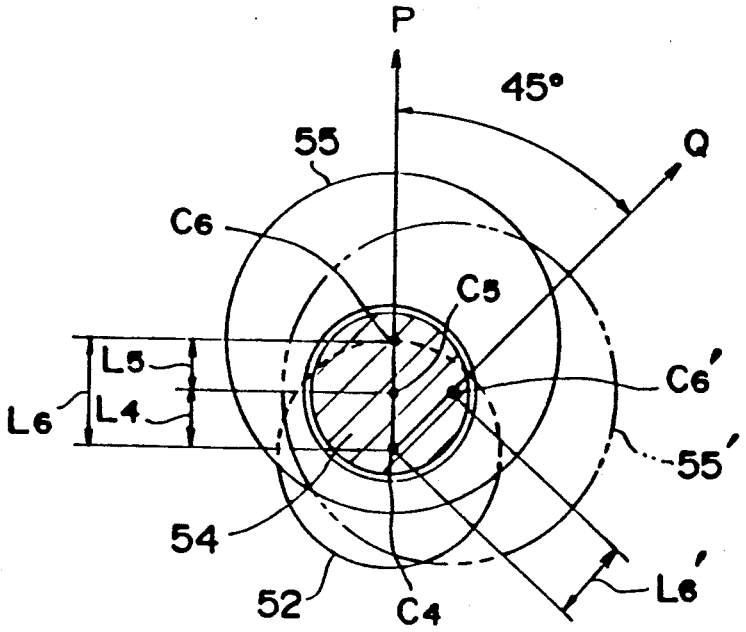
FIG. 10 is schematic view showing the positional relationship between the axes of members of a hydraulic motor of the continuously variable transmission.

The main shaft 52 of the hydraulic motor M has one end (shown on the lefthand side of FIG. 7) splined to a holder 6 which is fixed to the transmission housing 1 by a bolt 6a. Therefore, the main shaft 52 is fixed with respect to the transmission housing 1. A crankpin 54 is integral to the other end of the main shaft 52. As shown in FIG. 10, the crankpin 54 has a central axis C5 which is spaced or eccentrically displaced from the central axis C4 of the main shaft 52 by a distance L4. The crankpin 54 has its distal end fitted in a shaft support member 53. The main shaft 52, the crankpin 54, and the shaft support member 53 are rotatably supported as a unitary structure in the motor casing 51 by ball bearings 71a, 71b, and are rotatable about the central axis C4. Between the main shaft 52 and the bearing 71*a*, there are disposed a bearing 73 and a rotatable movable sleeve 56.

An eccentric collar 55 is rotatably mounted on the crankpin 54, the eccentric collar 55 having a central axis C6 which is spaced or eccentrically displaced from the crankpin axis C5 by a distance L5. The eccentric collar 55 has an internal gear 55*a* on one axial side thereof, the internal gear 55*a* meshing with an external gear 56*a* of the rotatable sleeve 56.

The rotatable sleeve 56 is angularly movably mounted on the main shaft 52 by the bearing 73. A worm gear 57 is splined to an end of the rotatable sleeve 56 and held in mesh with a worm pinion 58 supported by the transmission housing 1. The worm pinion 58 is normally held at rest against rotation, and hence the rotatable sleeve 56 and the eccentric collar 55 are also held at rest against rotation.

It is however possible to rotate the worm pinion 58 with an external device disposed outside of the transmission housing 1. When the pinion 58 is rotated, the rotatable sleeve 56 can be rotated with respect to the main shaft 52. The rotation of the rotatable sleeve 56 is transmitted through the gears 56*a*, 55*a* to the eccentric collar 55, which is rotated about the crankpin 54.

FIG. 10 shows the manner in which the axis C6 of the eccentric collar 55 moved upon angular movement thereof. In FIG. 10, the eccentric collar 55 is shown as being angularly moved 90° clockwise about the crankpin 54, as indicated by the two-dot-and-dash line. Before the eccentric collar 55 is angularly moved, the axis C4 of the main shaft 52, the axis C5 of the crankpin 54, and the axis C6 of the eccentric collar 55 are positioned in line. At this time, the axis C6 is spaced from the axis C4 by a distance L3 which is the same as the sum of the distance L4, L5. When the eccentric collar 55 is turned 90° about the crankpin into a position indicated by 55', the axis C6 of the eccentric collar 55 moves to a position indicated by C6'. Therefore, the distance between the axis C4 of the main shaft 52 and the axis C6 of the eccentric collar 55 (i.e., the radius with which the axis C6 of the eccentric collar 55 will revolve around the axis C4 of the main shaft 52 in the operation of the transmission CVT) becomes L6' (<L6).

The distance L6 is maximum when the axes C4, C5, C6 are arranged in line as shown in FIG. 10. As the eccentric collar 55 is progressively angularly moved, the distance L6 decreases. The distance L6 becomes minimum when the eccentric collar 55 is turned 180°. If the distance L4 and the distance L5 are equal to each other, the distance L6 becomes zero when the eccentric collar 55 is turned 180°.

A coupling ring 60 is rotatably mounted on the eccentric collar 55 by a needle bearing 74, so that the coupling ring 60 is rotatable on the eccentric collar 55 about the axis C6 thereof. Five radial motor cylinders 65 are disposed around the coupling ring 60. Each of the motor cylinders 65 is swingably supported in the motor casing 51 by a pair of trunnions 65*b*.

The cylinders 65 have respective cylinder bores 65*a* opening radially inwardly. Four motor plungers 62 and one motor plunger 63 are slidably inserted in the respective cylinder bores 65*a* through their radially inner ends. The four motor plungers 62 have radially inner ends 62*a* pivotally coupled to four arms 60*a*, respectively, of the coupling ring 60 by pins 61. The one motor plunger 63 has a radially inner end 63*a* integral to the coupling ring 60.

The cylinder bores 65*a* communicate with a fourth circuit oil passage 4*d* defined in the motor casing 51 through an oil passage 65*c* which is defined in those trunnions 65*b* which are disposed on one side of the cylinder bores 65*a*.

The fourth circuit oil passage 4*d* is selectively brought into communication with the first circuit oil passage 4*a* or the third circuit oil passage 4*c* by a distribution mechanism 80 that is disposed in the region where the pump casing 11 and the motor casing 51 are integrally joined to each other. The distribution mechanism 80 will be described below with reference to FIGS. 7 and 11.

The distribution mechanism 80 has a distribution housing 81 sandwiched between the pump and motor casings 11, 51. The transmission housing 81 has five spool insertion holes 81*a* defined therein and extending radially in aligment with the cylinders 65 of the hydraulic motor M. Distribution spools 82 are slidably inserted in the respective spool insertion holes 81*a*. The distribution spools 82 have radially outer ends retained by an outer retaining ring 84 and radially inner ends held against an outer circumferential surface 85*a* of a ball bearing 85 mounted on a distribution cam 86.

The distribution cam 86 is rotatably mounted on an end of the shaft support member 53 which is integrally coupled to the main shaft 52. The distribution cam 86 has an internal gear 86*a* on one axial end thereof. The internal gear 86*a* is in mesh with an external gear 87*a* on one end of the drive shaft 87 which axially extends through the main shaft 52, the crankpin 54, and the shaft support member 53. The other end of the drive shaft 87 supports a worm gear 88 splined thereto. The worm gear 88 is held in mesh with a worm pinion 89 which is supported by the transmission housing 1. The worm pinion 89 is normally held at rest against rotation, and hence the distribution cam 86 is also held at rest against rotation. However, the worm pinion 89 can be rotated with an external device to rotate the distribution cam 86. The drive shaft 87 is of a hollow construction with the second oil supplementing passage 8*b* defined therethrough.

Figure 11:
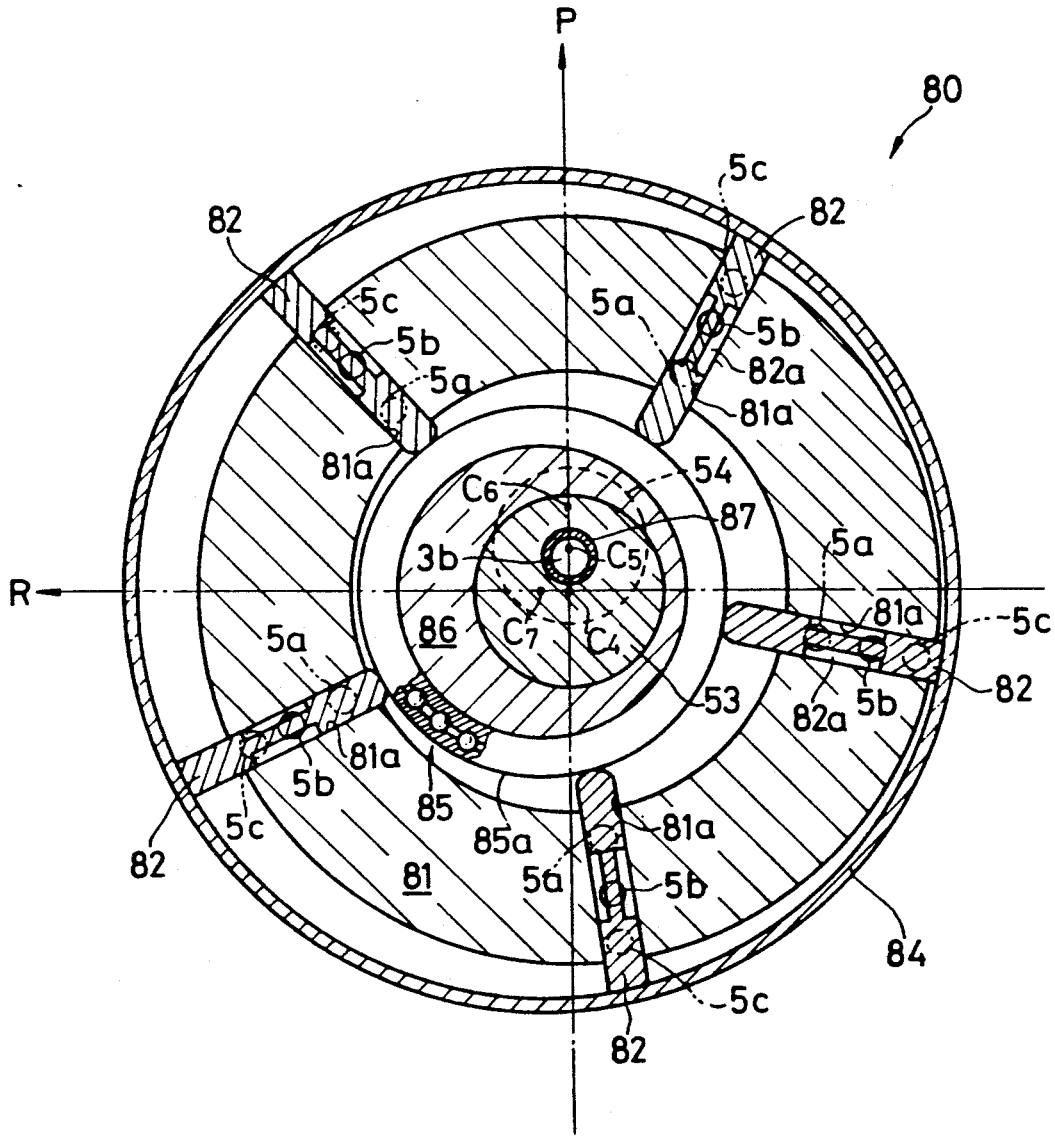
FIG. 11 is a cross-sectional view taken along line XI—XI of FIG. 7, the view showing a distribution mechanism of the continuously variable transmission.

As illustrated in FIG. 11, the outer circumferential surface of the distribution cam 86 has a center C7 which is spaced or eccentrically displaced from the axis C4 of the shaft support member 53 (i.e., the axis of the main shaft 52), and the ball bearing 85 mounted on the outer circumferential surface of the distribution cam 86 also has its center at C7. Therefore, when the distribution housing 81 rotates with the pump casing 11 and the motor casing 51, the distribution spools 82 with their inner ends slidably held against the outer circumferential surface of the ball bearing 85 are successively reciprocally moved in the respective spool insertion holes 81*a* by a distance corresponding to the distance by which the center C7 is spaced from the axis C4. The distribution cam 86 and the ball bearing 85 jointly serve as a distribution cam mechanism.

The inner circumferential surface of the distribution cam 86 has its center at C4. When the distribution cam 86 is rotated by the worm pinion 89, the center C7 of the outer circumferential surface of the distribution cam 86 revolves around the center C4. Therefore, when the worm pinion 89 is angularly moved, the top and bottom dead centers of the reciprocating stroke of the distribution spool 82 can be displaced.

The distribution housing 81 has defined therein first communication holes 5*a* communicating with the first circuit oil passage 4a, second communication holes 5b communicating with the fourth circuit oil passage 4d, and third communication holes 5c communicating with the third circuit oil passage 4c, the communication holes 5a, 5b, 5c also communicating with the spool insertion holes 81a. The spools 82 also have spool grooves 82a. Depending on the reciprocating movement of the spools 82 in the spool insertion holes 81a, the first and second communication holes 5a, 5b communicate with each other through the spool grooves 82a, or the second and third communication holes 5b, 5c communicate with each other through the spool grooves 82a. More specifically, when the distribution spools 82 move radially outwardly, the second and third communication holes 5b, 5c communicate with each other. When the distribution spools 82 move radially inwardly, the first and second communication holes 5a, 5b communicate with each other.

The hydromechanical continuously variable transmission CVT operates as follows:

The transmission CVT is operated when the main shaft (transmission input shaft) 12 rotates. When the main shaft 12 rotates, the eccentric collar 15 rotates therewith. The coupling ring 20 which is rotatably mounted on the eccentric collar 15 revolves with the axis C3 of the eccentric collar 15 around the axis C1 of the main shaft 12. Therefore, the pump plungers 22, 23 coupled to the coupling ring 20 reciprocally move in the respective cylinder bores 25a in the pump cylinder 25.

Figure 8:
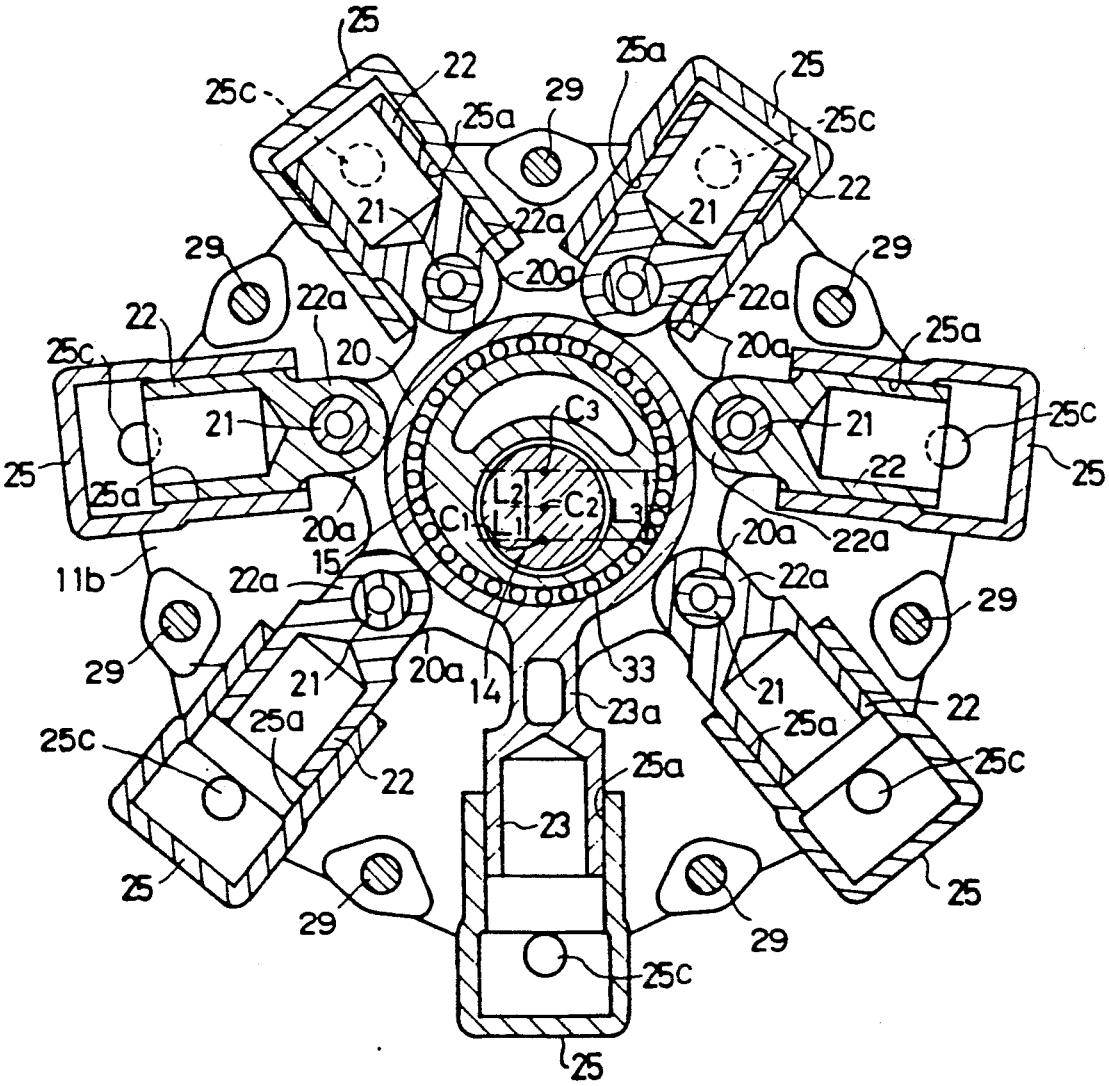
FIG. 8 is a cross-sectional view taken along line VIII—VIII of FIG. 7, the view showing a hydraulic pump of the continuously variable transmission.
Figure 12:
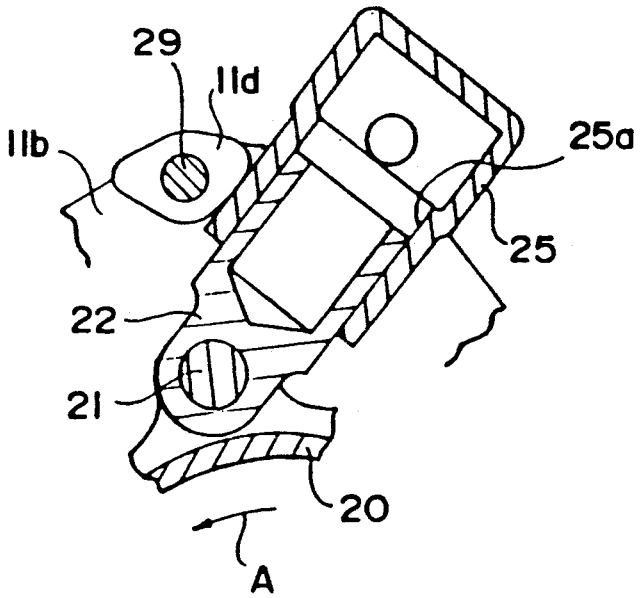
FIG. 12 is a fragmentary cross-sectional view of a portion of the hydraulic pump.

The pump plunger 23 is integrally joined to the coupling ring 20 in FIG. 8. If the pump plunger 23 were pivotally coupled to the coupling ring 20, as with the other pump plungers 22, then the coupling ring 20 would freely rotate with respect to the pump casing 11, as shown in FIG. 12. Therefore, the coupling ring 20 would also rotate in the direction indicated by the arrow A in response to rotation of the main shaft 12 in the same direction. Then, the cylinder 25 would abut at an outer side thereof against a flange 11d of the casing member 11b where the bolt 29 is threaded, or the plunger 22 would be displaced out of the cylinder 25 if the flange 11d were spaced far apart from the cylinder 25. Therefore, the plungers 22 would not reciprocally move reliably. To avoid the above problem in the illustrated embodiment, the single plunger 23 is integrally joined to the coupling ring 20 to prevent the coupling ring 20 from being angularly displaced beyond a certain angular interval with respect to the casing 11. Upon revolution of the coupling ring 20, the pump plungers 22, 23 smoothly reciprocally move in the cylinder bores 25a in the pump cylinders 25.

Figure 13:
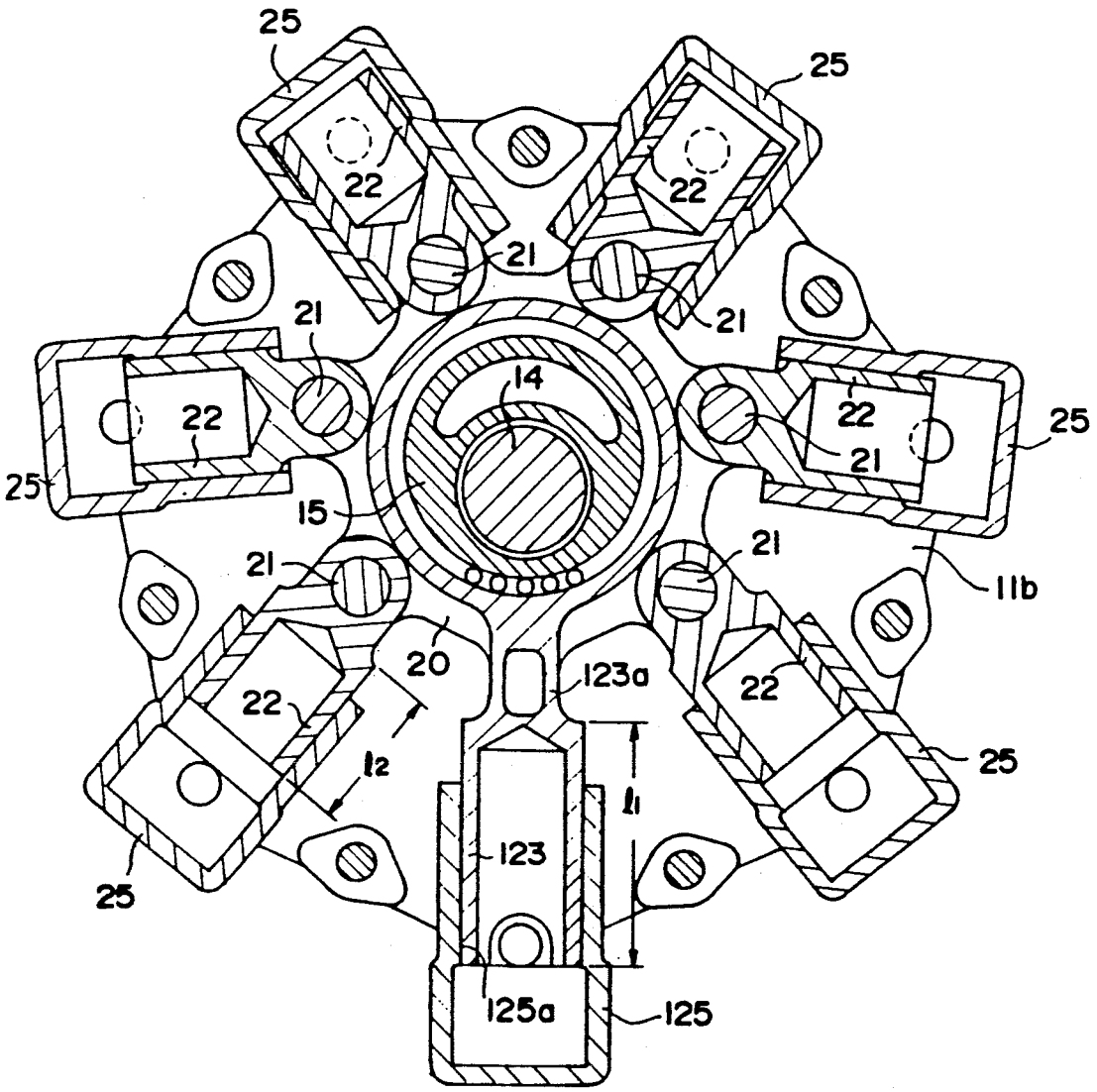
FIGS. 13 and 14 are cross-sectional views showing different relative displacement preventing means in a hydraulic unit.

Therefore, the pump plunger 23 integrally joined to the coupling ring 20 serves as a relative displacement preventing means for preventing the coupling ring 20 from being angularly displaced beyond a certain angular interval with respect to the casing 11. With this arrangement, however, the pump plunger 23 is subjected to a circumferential external force (applied perpendicularly to the axis of the pump plunger 23). To eliminate adverse effects of such an external force, a pump plunger 123 and a pump cylinder 125 may be constructed as shown in FIG. 13. The pump plunger 123 has a sliding portion having a length 11 which is larger than the length 12 of the sliding portion of the other pump plungers 22. The pump cylinder 125 has a cylinder bore 125a which is of a corresponding increased length. The longer pump cylinder 125 with the longer pump plunger 123 slidably inserted therein is effective in reducing the contact pressure which is applied to the sliding surface of the plunger 123 due to the external force imposed thereon.

Figure 14:
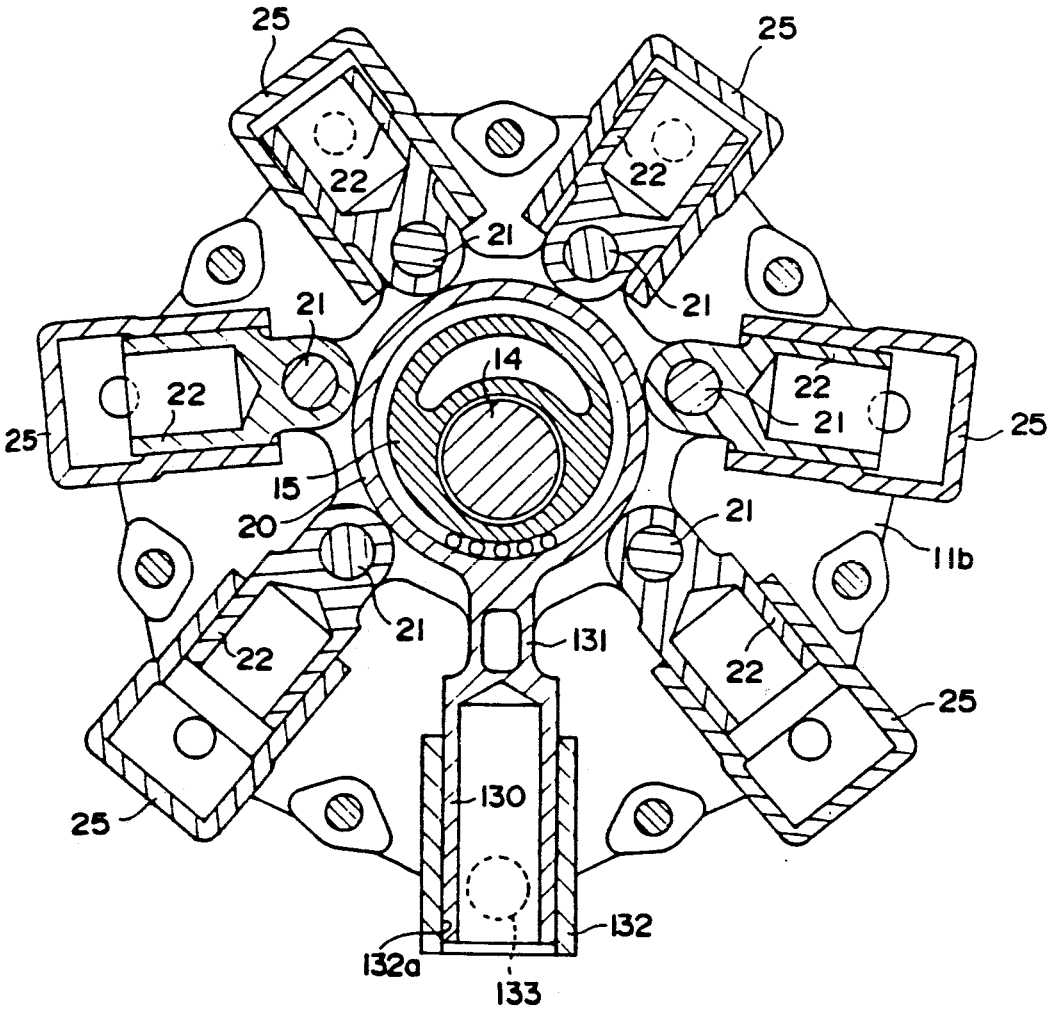

FIG. 14 shows another relative displacement preventing means which is not composed of a pump plunger and a pump cylinder. A radially outwardly extending rod 130 is integrally joined at its inner end 131 to the coupling ring 20. The rod 130 is slidably inserted in a guide hole 132 defined in a guide 132 that is swingably mounted on the casing 11 by a trunnion 133. The relative displacement preventing means shown in FIG. 14 can be designed and positioned with greater freedom since it is disposed independently of the positions of the pump plungers and the pump cylinders.

When the pump plungers 22, 23 reciprocally move, working oil is drawn through the first circuit oil passage 4a and the second circuit oil passage 4b into those cylinder bores 25a which receive the plungers in an expansion stroke, and working oil is discharged from those cylinder bores which receive the plungers in a contraction stroke and through the second circuit oil passage 4b into the third circuit oil passage 4c. Since the plunger 22, 23 are connected to the coupling ring 20, bidirectional forces which tend to push and pull the plungers 22, 23 can be transmitted from the coupling ring 20 to the plungers 22, 23. As a consequence, the working oil can smoothly be drawn into the cylinder bores in the expansion stroke without need for a charging pump which would pressurize the working oil to be drawn.

The working oil which is discharged into the third circuit oil passage 4c flows through the third and second communication holes 5c, 5b and is supplied into the motor cylinder bores 65a which receive the motor plungers 62, 63 in an expansion stroke, thereby moving these motor plungers in an expanding direction, i.e., a radially inward direction. As the motor plunger move in the expanding direction, the coupling ring 60 to which the motor plunders 62, 63 are connected rotates on the eccentric collar 55, whereupon the motor cylinder casing 51 is rotated. A rotative component of the hydraulic reactive force which is applied to the pump cylinders 25 at this time acts as a mechanical force to rotate the pump cylinder casing 11 and the motor cylinder casing 51 coupled thereto. The rotation is transmitted from the motor cylinder casing 51 to the transmission output shaft 91 through a drive gear 51c on an end of the cylinder casing 51 and a driven gear 91a meshing with the drive gear 51c.

When the motor cylinder casing 51 rotates, the motor plungers in a contraction stroke are contracted, i.e., moved radially outwardly, forcing the working oil from the corresponding cylinder bores 65a through the second and first communication holes 5b, 5a in the distribution mechanism 80 into the first circuit oil passage 4a. The working oil then returns from the first circuit oil passage 4a to the hydraulic pump P in which it is supplied to the cylinder bores 25a in the expansion stroke. In this manner, the working oil circulates in the transmission CVT.

When the main shaft 12 is driven, as described above, the working oil discharged from the hydraulic pump P is supplied to the hydraulic motor M to drive the same. At the same time, the hydraulic motor M is also driven by the mechanical force produced by the rotative component of the hydraulic reactive force applied to the pump cylinders 25. The working oil which has driven the hydraulic motor M is discharged into the first circuit oil passage 4*a* and then drawn into the hydraulic pump P. Any oil leakage which is caused in the circulation through the transmission CVT is compensated for by oil supplied from the first through fourth oil supplementing passages 3*a* through 3*d*.

While the hydraulic motor M is being driven, the rate at which the working oil is discharged from the hydraulic pump P corresponds to the relative rotational speed between the main shaft 12 and the pump casing 11. Inasmuch as the pump casing 11 is rotatably supported and integrally coupled to the motor cylinder casing 51, the rate at which the working oil is discharged from the hydraulic pump P is proportional to the difference between the rotational speeds of the main shaft 12 and the motor cylinder casing 51 insofar as the displacement of the hydraulic pump P is constant.

The displacement of the hydraulic pump P (i.e., the amount of working oil discharged by the hydraulic pump P) is proportional to the reciprocating stroke of the pump plungers 22, 23. The reciprocating stroke of the pump plungers 22, 23 can be varied when the lever 18 is turned to adjust the distance L3 by which the eccentric collar 15 is eccentrically displaced with respect to the main shaft 12. As shown in FIG. 9, the distance L3 is maximum when the axes C1, C2, C3 are arranged in line. The distance L3 decreases as the eccentric collar 15 is turned from the solid-line position, and becomes minimum when the eccentric collar 15 is turned 180°. Accordingly, the pump displacement can continuously be varied from the maximum to the minimum level in response to angular movement of the lever 18.

If the distance L1 is equal to the distance L2, the minimum value of the distance L3 (revolving radius) becomes zero and the minimum level of the pump displacement becomes zero when the eccentric collar 15 is turned 180°. At this time, no working oil is discharged from the pump P even when the main shaft 12 rotates, and the transmission CVT is in a neutral position.

Likewise, the displacement of the hydraulic motor M can be varied from the maximum to the minimum level depending on the rotation of the worm pinion 58. The minimum value of the displacement of the hydraulic motor M is zero if the distance L4 is equal to the distance L5.

By controlling the angular interval through which the lever 18 is turned, lever 18 and the angular interval through which the worm pinion 58 is rotated, it is theoretically possible to continuously vary the ratio of the rotational speed of the transmission input shaft, i.e., the main shaft 12, to the rotational speed of the transmission output shaft 91 (=input rotational speed/output rotational speed), i.e., the speed reduction ratio, from an infinite value to 1.0. The speed reduction ratio is infinite when the hydraulic motor M has a predetermined displacement and the hydraulic pump P has a displacement very close to zero. When the hydraulic pump P has a predetermined displacement and the hydraulic motor M has a zero displacement, the speed reduction ratio is 1.0 (the main shaft 12 and the motor casing 51 are directly coupled to each other), and the power is transmitted entirely mechanically from the main shaft 12 to the output shaft 91.

The distribution mechanism 80 supplies the working oil from the hydraulic pump P into those cylinder bores 65*a* which receive the motor plungers in the expansion stroke, and returns the working oil from those cylinder bores 65*a* which receive the motor plungers in the contraction stroke to the hydraulic pump P. Therefore, an apogean direction of the eccentric ball bearing 85 (i.e., the direction indicated by the arrow R (FIG. 11) for pushing the spools 82 outwardly by the greatest interval) is disposed in 90°-spaced relation to an apogean direction of the eccentric collar 55 (i.e., the direction indicated by the arrow P for positioning the plungers 62 in the top dead center).

When the worm pinion 58 is turned to rotate the eccentric collar 55 around the crankpin 54 in order to change the displacement of the hydraulic motor M, the apogean direction of the eccentric collar 55 is also varied. For example, when the eccentric collar 55 is turned 90° around the crankpin 54, the center of the eccentric collar 55 is moved from C6 to C6', and the apogean direction thereof is angularly shifted 45° from the direction indicated by the arrow P to the direction indicated by the arrow Q. Therefore, it is also necessary to shift the apogean direction of the eccentric ball bearing 85 in the distribution mechanism 80 by 45°. The apogean direction of the eccentric ball bearing 85 is shifted when the worm pinion 89 rotates.

If the apogean direction of the ball bearing 85 is 180° reversed from the direction indicated by the arrow R in FIG. 11 by the worm pinion 89, then the motor M rotates in the opposite direction. Therefore, the transmission CVT can be shifted in to a reverse position by the worm pinion 89.

Figure 15:
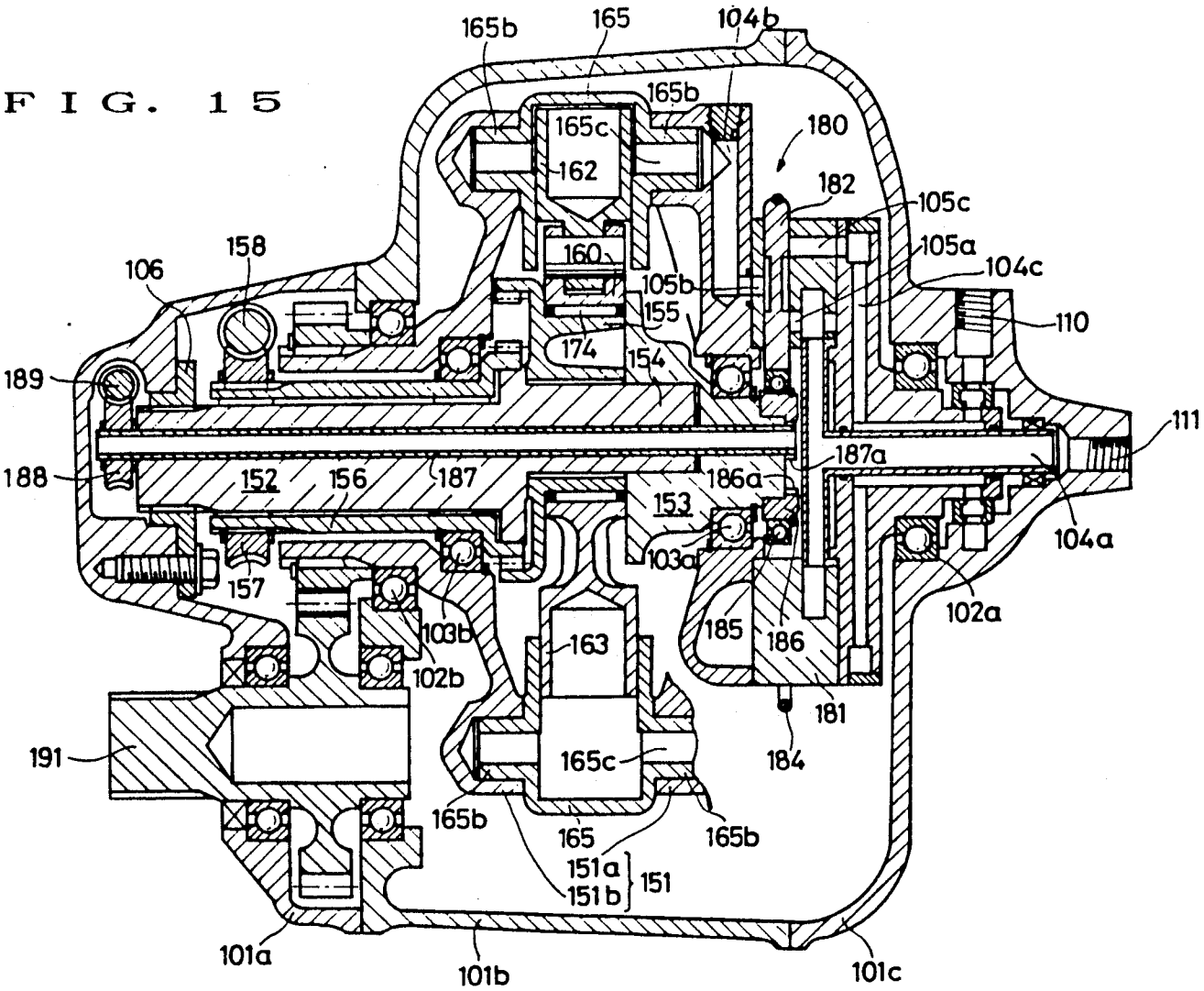
FIG. 15 is a cross-sectional view of a hydraulic unit according to an embodiment of the present invention.
Figure 16:
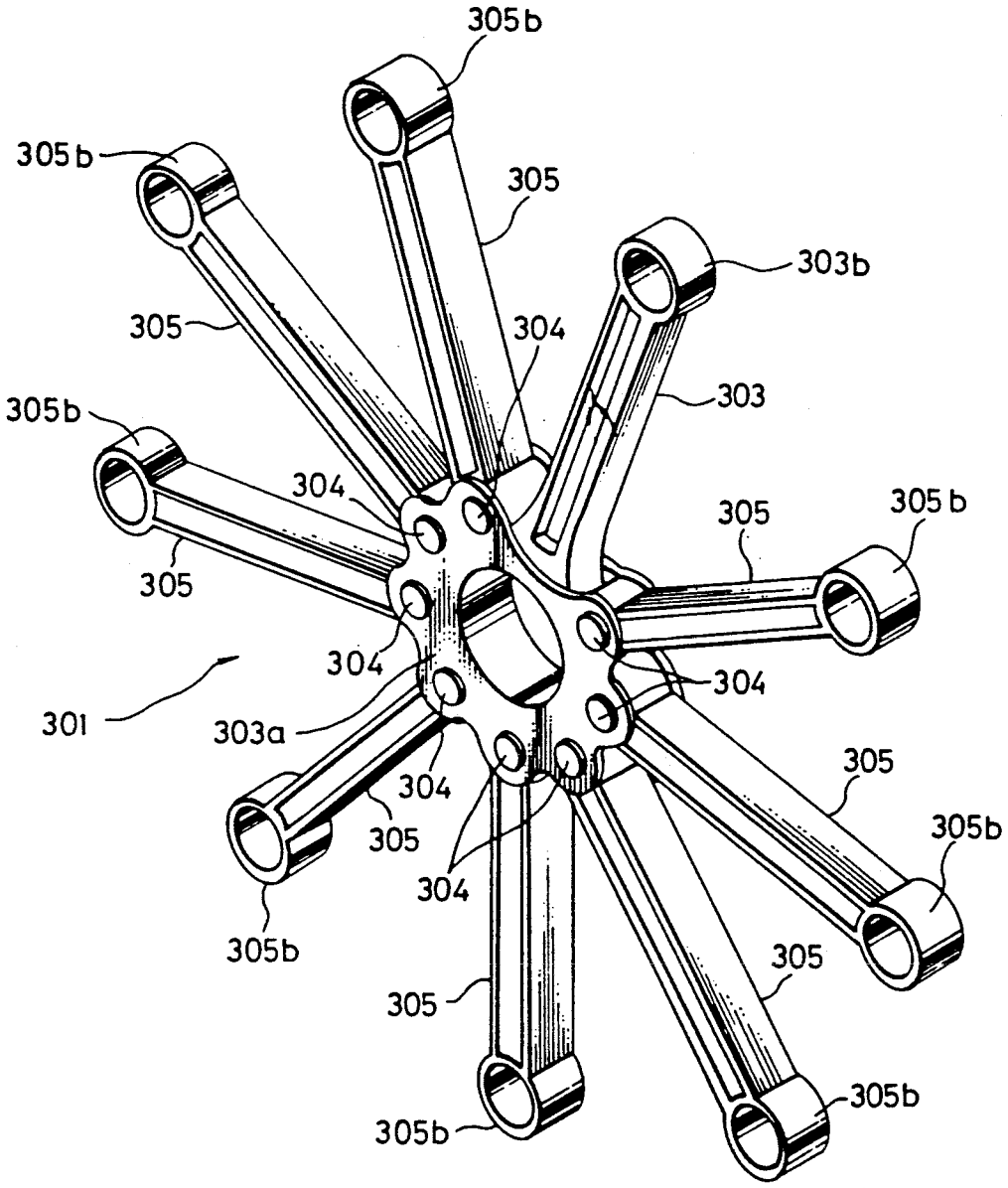
FIG. 16 PRIOR ART
FIGS. 16 and 17 are perspective views of connecting rod assemblies which interconnect hydraulic actuators and a crankpin in conventional hydraulic devices.
Figure 17:
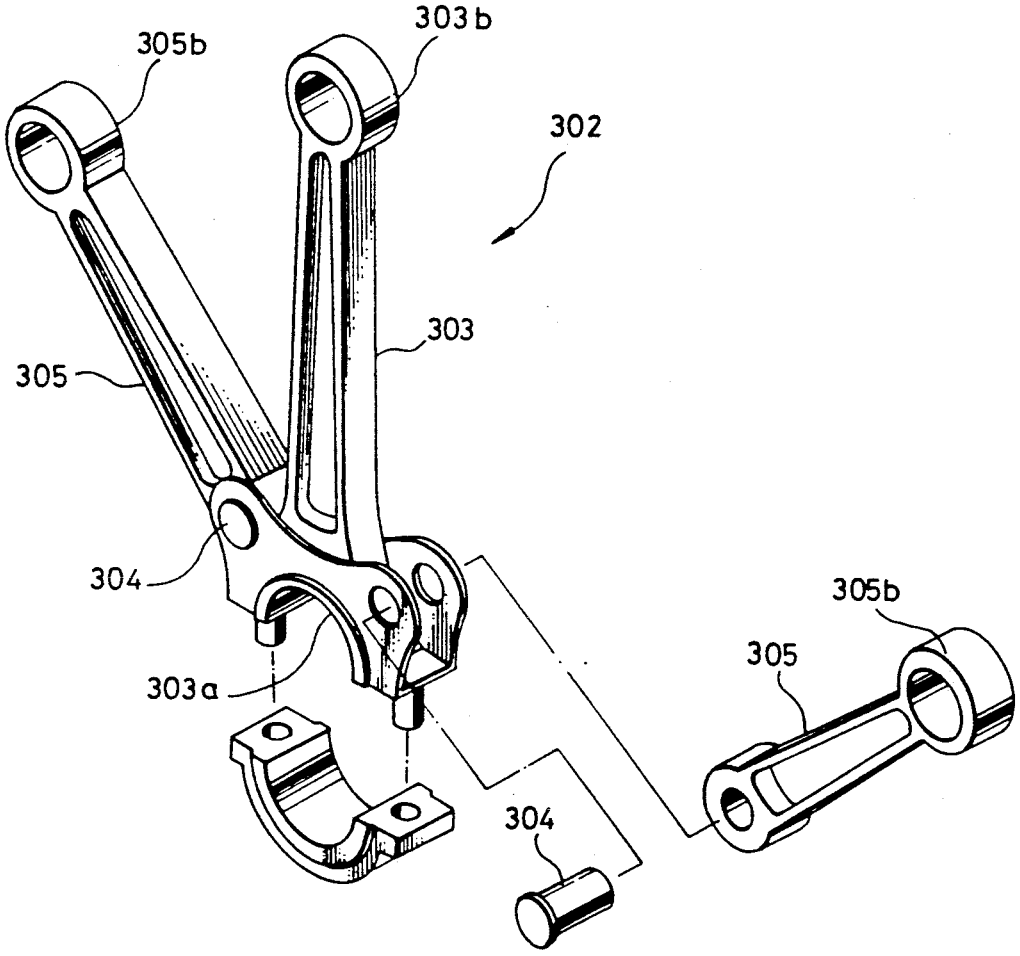
FIG. 17 PRIOR ART

In the above embodiment, the hydromechanical continuously variable transmission CVT is composed of the hydraulic pump P and the hydraulic motor M. Now, a radial-plunger-type hydraulic unit HU which can be used as a hydraulic pump or a hydraulic motor will be described with reference to FIG. 15.

The hydraulic unit HU has a housing 101 which comprises three housing members 101*a*, 101*b*, 101*c*. The hydraulic unit HU also has components similar to those of the hydraulic motor M shown in FIG. 7, the components being accommodated in the housing 101.

A casing 151 which comprises two casing members 151*a*, 151*b* fastened to each other by bolts is rotatably supported in the housing 101 by a pair of ball bearings 102*a*, 102*b*. A main shaft 152 extends axially centrally in the casing 151, and rotatably supported in the casing 151 by a pair of bearings 103*a*, 103*b*. The main shaft 152 is splined at one end to a holder 106 which is fixed to the housing 101.

A crankpin 154 is integral to the other end of the main shaft 152, the crankpin 154 having a central axis C5 which is spaced a distance L4 from the central axis C4 of the main shaft 152. These axes are positioned in the same manner as shown in FIG. 10. The crankpin 154 has its distal end fitted in a shaft support member 153. The main shaft 152, the crankpin 154, and the shaft support member 153 are rotatably supported as a unitary structure in the casing 151.

An eccentric collar 155 is rotatably mounted on the crankpin 154, the eccentric collar 155 having a central axis C6 which is spaced from the crankpin axis C5 by a distance L5. The eccentric collar 155 has an internal gear on one axial side thereof, the internal gear meshing with an external gear of a rotatable sleeve 156.

The rotatable sleeve 156 is angularly movably mounted on the main shaft 152. A worm gear 157 is mounted on an end of the rotatable sleeve 156 and held in mesh with a worm pinion 158 supported by the housing 101. When the worm pinion 158 is rotated, the rotatable sleeve 156 is rotated relatively to the main shaft 152. The rotation of the rotatable sleeve 156 is transmitted to the main eccentric collar 155, which is angularly moved about the crankpin 154.

When the eccentric collar 155 is turned, the axis C6 thereof is angularly moved in the same manner as shown in FIG. 10.

A coupling ring 160 is rotatably mounted on the eccentric collar 155 by a needle bearing 174, so that the coupling ring 160 is rotatable on the eccentric collar 155 about the axis C6 thereof. Five radial cylinders 165 are disposed around the coupling ring 160. Each of the cylinders 165 is swingably supported in the casing 151 by a pair of trunnions 165*b*. The cylinders 165 have respective cylinder bores opening radially inwardly. Four plungers 162 and one plunger 163 are slidably inserted in the respective cylinder bores 165*a* through their radially inner ends. These components are the same as those of the hydraulic motor M shown in FIG. 7, and will not be described in detail.

The cylinder bores communicate with a second oil passage 104*b* defined in the casing 151 through an oil passage 165*c* which is defined in those trunnions 165*b* which are disposed on one side of the cylinder bores 165*a*. The second oil passage 104*b* is connected to a distribution mechanism 180 coupled to the casing 151.

The distribution mechanism 180 comprises a distribution housing 181 integral to the casing 151, distribution spools 182 slidably inserted in respective spool insertion holes defined in the housing 181 in alignment with the cylinders 165, an outer retaining ring 184 which retains the radially outer ends of the spools 182, a rotatable sleeve 186 rotatably mounted on an end of the shaft support member 153, and a ball bearing 185 eccentrically mounted on the rotatable sleeve 186. The rotatable sleeve 186 has an internal gear 186 meshing with an external gear 187*a* on an end of a drive shaft 187 extending axially through the main shaft 152. The drive shaft 187 has on its other end a worm gear 188 held in mesh with a worm pinion 189. The distribution mechanism 180 is of the same structure as that of the distribution mechanism 80 in the transmission CVT shown is FIG. 7.

The distribution housing 181 has defined therein second communication holes 105*b* communicating with the second oil passage 104*b*, first communication holes 105*a* communicating with the first oil passage 104*a*, and third communication holes 105*c* communicating with third oil passage 104*c*, the communication holes 105*a*, 105*b*, 105*c* also communicating with the spool insertion holes. When the housing 181 rotates with the casing 151, the spools 182 are reciprocally moved in the spool insertion holes, and the first and second communication holes 105*a*, 105*b* communicate with each other through spool grooves, or the second and third communication holes 105*b*, 105*c* communicate with each other through the spool grooves. The first oil passage 104*a* communicates with a discharge port 111, whereas the third oil passage 104*c* communicates with a suction port 110.

The casing 151 is operatively coupled to a shaft 191 through intermeshing drive and driven gears on ends thereof, so that rotation of the casing 151 is transmitted to the shaft 191.

The hydraulic unit HU of the above construction may be used as a hydraulic motor or a hydraulic pump.

If the hydraulic unit HU is used as a hydraulic motor, working oil under pressure is supplied from the suction port 110 into the third oil passage 104*c*. The working oil is then fed into those cylinder bores which receive the plungers in an expansion stroke. The plungers in these cylinder bores are moved in an expanding direction. In response to the movement of the plungers, the coupling ring 160 coupled thereto rotates on the eccentric collar 155, thereby rotating the casing 151. The rotation of the casing 151 is transmitted to the shaft 191 through the intermeshing drive and driven gears thereof, so that the shaft 191 rotates about its own axis.

When the casing 151 rotates, the plungers in a contraction stroke are contracted to discharge the working oil from their cylinder bores through the second communication holes 105*b* and the first oil passage 104*a* into the discharge port 111.

If the hydraulic unit HU is used as a hydraulic pump, the shaft 191 is rotated to discharge working oil, which has been drawn from the suction port 110, from the discharge port 111.

The port 110 may be employed as a discharge port, and the port 111 may be used as a suction port.

The displacement of the hydraulic unit, whether used as a hydraulic motor or pump, can be varied when the worm pinion 158 is rotated. Such displacement control will not be described in detail since it may be carried out in the same manner as with the hydraulic motor M shown in FIG. 7.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable-stroke crank mechanism comprising:

a casing;

a main shaft rotatably mounted in said casing, said main shaft having an eccentric crankpin, said crankpin having a first axis;

a plurality of fluid pressure actuators disposed substantially radially with respect to said main shaft, for pressing said eccentric crankpin to rotate said main shaft and said casing relatively to each other;

working fluid supply means for selectively supplying a working fluid to said fluid pressure actuators;

an eccentric collar rotatably mounted on said crankpin and operatively coupled to said fluid pressure actuators, said eccentric collar having a second axis which is eccentrically displaced with respect to said first axis; and arresting means disposed between said crankpin and said eccentric collar, for arresting said crankpin and said eccentric collar in respective angular positions, wherein said arresting means comprises a gear integral to said eccentric collar, and a pinion meshing with said gear and mounted on said main shaft against rotation about its own axis.

2. A variable stroke crank mechanism comprising:

a casing;

a main shaft rotatably mounted in said casing, said main shaft having an eccentric crankpin, said crankpin having a first axis;

a plurality of fluid pressure actuators disposed substantially radially with respect to said main shaft, for pressing said eccentric crankpin to rotate said main shaft and said casing relatively to each other;

working fluid supply means for selectively supplying a working fluid to said fluid pressure actuators;

an eccentric collar rotatably mounted on said crankpin and operatively coupled to said fluid pressure actuators, said eccentric collar having a second axis which is eccentrically displaced with respect to said first axis; and arresting means disposed between said crankpin and said eccentric collar, for arresting said crankpin and said eccentric collar in respective angular positions, wherein said arresting means comprises a gear integral to said eccentric collar, a pinion meshing with said gear and rotatably mounted on said main shaft, and a position adjusting mechanism for adjusting relative angular positions of said pinion and said main shaft.

3. A variable-stroke crank mechanism according to claim 1 or 2, wherein said gear comprises an internal gear.

4. A variable-stroke crank mechanism according to claim 1 or 2, wherein said gear comprises an external gear.

5. A variable-stroke crank mechanism according to claim 1 or 2, wherein said main shaft comprises a first shaft member with said crankpin integral thereto, and a second shaft member having a hole in which said crankpin is fitted.

6. A variable-stroke crank mechanism according to claim 2, wherein said position adjusting mechanism comprises a slider interposed between said pinion and said main shaft, said slider engaging one of said pinion and said main shaft through axially straight splines and engaging the other through helical splines.

7. A variable-stroke crank mechanism according to claim 2, wherein said position adjusting mechanism comprises a slider interposed between said pinion and said main shaft, said slider engaging said pinion and said main shaft through helical splines inclined in opposite directions.

8. A variable-stroke crank mechanism according to claim 1 or 2, wherein said first axis of the crankpin is eccentrically displaced from the axis of said main shaft by a distance, and said second axis of the eccentric collar is eccentrically displaced from said first axis by a distance which is the same as said first-mentioned distance.

9. A variable-stroke crank mechanism according to claim 1 or 2, wherein said eccentric collar comprises a base rotatably mounted on said crankpin, and a guide rotatably mounted on said base in eccentric relation to said crankpin.

10. A variable-stroke crank mechanism according to claim 9, wherein said guide has a convex outer spherical surface, said fluid pressure actuators having radially inner ends having concave inner spherical surfaces complementary to said convex outer spherical surface, said convex outer spherical surface of said guide and said concave inner spherical surfaces being slidably held against each other.

11. A variable-stroke crank mechanism according to claim 1 or 2, further including a coupling ring rotatably mounted on said eccentric collar, said fluid pressure actuators being connected to said coupling ring.

12. A plunger-type hydraulic unit comprising:

a casing:

a main shaft rotatably mounted in said casing;

a cam member eccentrically mounted on said main shaft and rotatable with the main shaft;

a coupling ring rotatably mounted on said cam member;

a plurality of cylinders disposed substantially radially with respect to said main shaft in surrounding relation to said coupling ring, said cylinders being swingably mounted in said casing;

a plurality of plungers slidably fitted in said cylinders, respectively, and having radially inner ends pivotally connected to said coupling ring; and relative displacement preventing means for bearing a circumferential force acting on said coupling ring to prevent said coupling ring from being displaced relatively to said casing beyond a predetermined angle.

13. A plunger-type hydraulic unit according to claim 12, wherein one of said plungers is integral to said coupling ring, said relative displacement preventing means comprising said one of the plunders and one of said cylinders in which said one plunger is slidably fitted.

14. A plunger-type hydraulic unit according to claim 12, wherein said relative displacement preventing means comprises a rod integral to said coupling ring and extending radially outwardly, and a guide swingably connected to said casing and having a guide hole in which said rod is slidably fitted.

15. A plunger-type hydraulic unit according to claim 12, further comprising a crankpin integral to said main shaft and having a first axis which is eccentrically displaced with respect to the axis of said main shaft.

16. A plunger-type hydraulic unit according to claim 15, wherein said cam member comprises an eccentric collar rotatably mounted on said crankpin, and arresting means for arresting said eccentric collar against rotation with respect to said crankpin.

17. A plunger-type hydraulic unit according to claim 16, wherein said eccentric collar has a second axis which is eccentrically displaced with respect to the first axis of said crankpin, said arresting means having a position adjusting mechanism for adjusting an angular position of said eccentric collar on said crankpin.

18. A plunger-type hydraulic unit according to claim 16, wherein said arresting means comprises a gear integral to said eccentric collar, and a pinion meshing with said gear and mounted on said main shaft against rotation about its own axis.

19. A plunger-type hydraulic unit according to claim 16, wherein said arresting means comprises a gear integral to said eccentric collar, a pinion meshing with said gear and rotatably mounted on said main shaft, and a position adjusting mechanism for adjusting relative angular positions of said pinion and said main shaft.

20. A plunger-type hydraulic unit according to claim 17, wherein said position adjusting mechanism comprises a slider interposed between said pinion and said main shaft, said slider engaging one of said pinion and said main shaft through axially straight splines and engaging the other through helical splines.

21. A plunger-type hydraulic unit according to claim 17, wherein said position adjusting mechanism comprises a slider interposed between said pinion and said main shaft, said slider engaging said pinion and said main shaft through helical splines inclined in opposite directions.

22. A plunger-type hydraulic unit according to claim 17, wherein said first axis of the crankpin is eccentrically displaced from the axis of said main shaft by a distance, and said second axis of the eccentric collar is eccentrically displaced from said first axis by a distance which is the same as said first mentioned distance.

23. A plunger-type hydraulic unit according to claim 12, which is used as a hydraulic pump.

24. A plunger-type hydraulic unit according to claim 12, which is used as a hydraulic motor.

25. A plunger-type hydraulic unit comprising:

a fixed main shaft;

a cam member mounted on said main shaft;

a cylinder casing rotatable around said main shaft and having a plurality of cylinder bores defined therein;

a plurality of plungers slidably fitted in said cylinder bores, respectively, and connected to said cam member, so that said plungers reciprocally move in said cylinder bores in response to rotation of said cylinder casing; and a distribution mechanism for selectively bringing said cylinder bores into communication with inlet and outlet ports;

said distribution mechanism comprising a distribution housing integral to said cylinder casing, distribution spools radially slidably disposed in said distribution housing, a distribution cam rotatably mounted on one end of said main shaft and connected to radial inner ends of said distribution spools, and a drive shaft extending axially through said main shaft from the other end thereof to said one end and coupled to said distribution cam, whereby said distribution cam can be rotated on said main shaft by said drive shaft.

26. A plunger-type hydraulic unit according to claim 25, wherein said drive shaft is rotatable with respect to said main shaft, and drive shaft having an external gear on one end thereof, said distribution cam having an internal gear meshing with said external gear, whereby said distribution cam can be rotated when said drive shaft is rotated.

27. A plunger-type hydraulic unit according to claim 25, wherein said distribution housing has a first oil passage communicating with said cylinder bores, a second oil passage communicating with said inlet port, and a third oil passage communicating with said outlet port, said distribution spools having grooves for bringing said first and second oil passages into communication with each other or said first and third oil passages into communication with each other depending on the direction in which said distribution spools radially slide.

28. A plunger-type hydraulic unit according to claim 25, which is used as a hydraulic pump.

29. A plunger-type hydraulic unit according to claim 25, which is used as a hydraulic motor.

30. A hydromechanical continuously variable transmission comprising:

a transmission housing;

pump and motor cylinder casings integrally coupled to each other and rotatably supported in said transmission housing;

a plurality of pump plungers slidably disposed in said pump cylinder casing;

a plurality of motor plungers slidably disposed in said motor cylinder casing;

a pump shaft rotatably disposed in said pump cylinder casing in coaxial relation thereto;

a pump cam member mounted on said pump shaft for reciprocally sliding said pump plunger;

a motor shaft disposed coaxially in said motor cylinder casing and fixedly supported in said transmission housing; and a motor cam member mounted on said motor shaft for rotating said motor cylinder casing in response to reciprocating movement of said motor plungers.

31. A hydromechanical continuously variable transmission comprising:

a transmission housing;

pump and motor cylinder casings integrally coupled to each other and rotatably supported in said transmission housing, said pump and motor cylinder casings having cylinder bores;

a plurality of pump plungers slidably disposed in the cylinder bores in said pump cylinder casing;

a plurality of motor plungers slidably disposed in the cylinder bores in said motor cylinder casing;

a pump shaft rotatably disposed in said pump cylinder casing in coaxial relation thereto;

a pump cam member mounted on said pump shaft for reciprocally sliding said pump plungers;

a motor shaft disposed coaxially in said motor cylinder casing and fixedly supported in said transmission housing;

a motor cam member mounted on said motor shaft for rotating said motor cylinder casing in response to reciprocating movement of said motor plungers; and a distribution mechanism for selectively bringing said cylinder bores in said pump cylinder casing into communication with said cylinder bores in said motor cylinders;

said distribution mechanism comprising a distribution housing integral to said pump and motor cylinder casings, distribution spools radially slidably disposed in said distribution housing, a distribution cam rotatably mounted on one end of said motor shaft and connected to radial inner ends of said distribution spools, and a drive shaft extending axially through said motor shaft from the other end thereof to said one end and coupled to said distribution cam, whereby said distribution cam can be rotated on said motor shaft by said drive shaft.

32. A hydromechanical continuously variable transmission according to claim 31, wherein said drive shaft is of a hollow structure for charging working oil therethrough to said cylinder bores.

33. A hydromechanical continuously variable transmission according to claim 31, wherein said distribution housing having an oil passage communicating with the cylinder bores in said pump cylinder casing and an oil passage communicating with the cylinder bores in said motor cylinder casing, said distribution spools having grooves for bringing those cylinder bores in said pump cylinder casing which receive the pump plungers in a contraction stroke into communication with those cylinder bores in said motor cylinder casing which receive the motor cylinders in an expansion stroke, or bringing those cylinder bores in said pump cylinder casing which receive the pump plungers in an expansion stroke in communication with those cylinder bores in said motor cylinder casing which receive the motor cylinders in a contraction stroke, depending on the direction in which the distribution spools radially slide.

34. A variable-stroke crank mechanism comprising:

a casing;

a main shaft rotatably mounted in said casing, said main shaft being comprised of a first shaft member and a second shaft member, said main shaft having an eccentric crankpin integral with said first shaft member, said crankpin having a first axis, said second shaft having a hole in which said crankpin is fitted;

a plurality of fluid pressure actuators disposed substantially radially with respect to said main shaft, for pressing said eccentric crankpin to rotate said main shaft and said casing relatively to each other;

working fluid supply means for selectively supplying a working fluid to said fluid pressure actuators;

an eccentric collar rotatably mounted on said crankpin and operatively coupled to said fluid pressure actuators, said eccentric collar having a second axis which is eccentrically displaced with respect to said first axis; and arresting means disposed between said crankpin and said eccentric collar, for arresting said crankpin and said eccentric collar in respective angular positions.

35. A variable-stroke crank mechanism comprising:

a casing;

a main shaft rotatably mounted in said casing, said main shaft having an eccentric crankpin, said crankpin having a first axis;

a plurality of fluid pressure actuators disposed substantially radially with respect to said main shaft, for pressing said eccentric crankpin to rotate said main shaft and said casing relatively to each other;

working fluid supply means for selectively supplying a working fluid to said fluid pressure actuators;

an eccentric collar rotatably mounted on said crankpin and operatively coupled to said fluid pressure actuators, said eccentric collar having a second axis which is eccentrically displaced with respect to said first axis; said eccentric collar comprising a base rotatably mounted on said crankpin and a guide rotatably mounted on said base in eccentric relation to said crankpin, said guide having a convex outer spherical surface, said fluid pressure actuators having radially inner ends having concave inner spherical surfaces complementary to said convex outer spherical surface, said convex outer spherical surface of said guide and said concave inner spherical surfaces being slidably held against each other; and arresting means disposed between said crankpin and said eccentric collar, for arresting said crankpin and said eccentric collar in respective angular positions.

* * * * *

UNITED STATES PATENT AND TRADEMARK OFFICE

CERTIFICATE OF CORRECTION

PATENT NO. : 5,076,057

DATED : December 31, 1991

INVENTOR(S) : F. Maruno

It is certified that error appears in the above-identified patent and that said Letters Patent is hereby corrected as shown below:

Claim 13, column 24, line 18, delete "plunders" and insert -- plungers --.

Signed and Sealed this

Ninth Day of November, 1993

*Attest:*

*Attesting Officer*

BRUCE LEHMAN

*Commissioner of Patents and Trademarks*